US008626040B2

(12) United States Patent
Kasai et al.

(10) Patent No.: US 8,626,040 B2
(45) Date of Patent: Jan. 7, 2014

(54) IMAGE FORMING APPARATUS

(75) Inventors: Tadashi Kasai, Kanagawa (JP); Shinya Kobayashi, Kanagawa (JP); Akio Tsujita, Kanagawa (JP); Masato Iio, Kanagawa (JP); Katsuhiro Shinohara, Kanagawa (JP); Masakazu Terao, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 294 days.

(21) Appl. No.: 13/231,596

(22) Filed: Sep. 13, 2011

(65) Prior Publication Data

US 2012/0063819 A1 Mar. 15, 2012

(30) Foreign Application Priority Data

Sep. 14, 2010 (JP) ..... 2010-205327

(51) Int. Cl.
*G03G 15/01* (2006.01)

(52) U.S. Cl.
USPC ..... 399/298

(58) Field of Classification Search
USPC ..... 399/298, 299, 300, 302, 303
See application file for complete search history.

(56) References Cited

U.S. PATENT DOCUMENTS

| | | | | |
|---|---|---|---|---|
| 7,567,775 | B2 * | 7/2009 | Fukuhara | 399/302 |
| 7,729,650 | B2 * | 6/2010 | Tamaki | 399/299 |
| 7,769,328 | B2 * | 8/2010 | Murayama et al. | 399/299 |
| 8,000,617 | B2 * | 8/2011 | Kim et al. | 399/298 |
| 8,019,261 | B2 * | 9/2011 | Tamaki | 399/299 |
| 8,417,140 | B2 * | 4/2013 | Matsuzaki | 399/302 |
| 2010/0080589 | A1 * | 4/2010 | Yoshioka | 399/302 |
| 2010/0247129 | A1 * | 9/2010 | Hyakutake et al. | 399/298 |

FOREIGN PATENT DOCUMENTS

JP 8-26583 A 10/1996

* cited by examiner

*Primary Examiner* — Susan Lee
(74) *Attorney, Agent, or Firm* — Dickstein Shapiro LLP

(57) ABSTRACT

After at least one toner image is transferred to a medium to which an image is transferred from at least one of a plurality of image forming stations used, at least one toner image is transferred from at least one of the rest of the image forming stations, and this transfer operation is repeated a plurality of times to transfer toner images to the medium to which an image is transferred. In this manner, the toner images on the medium to which an image is transferred are formed using a desired number of color toner including a transparent toner. In addition, the order in which the transparent toner is transferred from the image forming station that is used for the transparent toner and toner other than the transparent toner is transferred from image forming stations in which the transparent toner is not used can be freely or automatically selected.

15 Claims, 8 Drawing Sheets

POSITION OF IMAGE FORMING STATION TO BE REPLACED WITH IMAGE FORMING STATION FOR TRANSPARENT TONER

1. Y 2. C 3. M 4. K 5. DEFAULT

INPUT 1, 2, 3, 4 OR 5?

| | STANDARD SPEED | | HALF SPEED | |
|---|---|---|---|---|
| BASIS WEIGHT [gsm] | FIXING LOWER LIMIT | FIXING UPPER LIMIT | FIXING LOWER LIMIT | FIXING UPPER LIMIT |
| 64 | 140 | 164 | | |
| 69 | 140 | 175 | | |
| 75 | 144 | 177 | | |
| 90 | 146 | 180 | 128 | 172 |
| 105 | 150 | 184 | 132 | 170 |
| 165 | | | 142 | 176 |

IMAGE FORMING APPARATUS

CROSS-REFERENCE TO RELATED APPLICATIONS

The present application claims priority to and incorporates by reference the entire contents of Japanese Patent Application No. 2010-205327 filed in Japan on Sep. 14, 2010.

BACKGROUND OF THE INVENTION

1. Field of the Invention

The present invention relates to an improvement in an electrophotographic image forming apparatus that uses a dry two-component developing method and, more specifically, to an image forming apparatus that allows high-value added printing using, for example, transparent toner.

2. Description of the Related Art

In the industrial field of conventional image forming apparatus, the majority of demand is from offices and SOHOs (Small Office/Home Office). Therefore, technological development has been made to satisfy the demand from offices and SOHOs, such as a reduction in installation area, a reduction in downtime, or improvement in usability. However, in recent image forming apparatuses, high-value added printing becomes increasingly popular because, for example, various image forming apparatus that can use transparent toner have been available on the market. Therefore, in the industrial field of image forming apparatus, the market of production printing in which output materials are used as products is becoming more active. The industrial field of image forming apparatus has been growing in recent years.

As described above, in the industrial field of recent image forming apparatus, high-value added printing becomes increasingly popular. However, the development of conventional image forming apparatus has been directed mainly to the use in offices and SOHOs. Therefore, if the basic platform of the image forming devices included in an image forming apparatus that has been developed before is used to perform high-value added printing, many technical problems will arise. For example, when high-value added printing is performed by using transparent toner, the configuration of image forming stations or the layout of an image forming engine must be significantly changed according to when the transparent toner is used in the procedure of image formation. More specifically, when only one color of transparent toner is added to conventionally and commonly used four basic colors of toner for cyan (C), magenta (M), yellow (Y), and black (K), the image formation layout must be fundamentally changed. Therefore, an image formation engine that can perform high-value added printing by using transparent toner must be newly designed according to an application for use, or the design of an existing image forming apparatus must be greatly changed. To achieve high-value added printing easily at low cost, various problems must be solved.

As an example of the image forming apparatus that can perform high-value added printing, Japanese Patent Application Laid-open No. H8-265583 discloses a color image forming apparatus in which a user can freely select performance with priority given to copy speed or capability of printing black characters with high quality according to the user's preference. In the image forming apparatus according to Japanese Patent Application Laid-open No. H8-265583, an image color recognition unit that allows selection as to whether the formation of a black image is performed first, second, or later is provided to achieve high-value added printing. However, the unit for achieving high-value added printing in the invention disclosed in Japanese Patent Application Laid-open No. H8-265583 is very complicated. Therefore, high-value added printing cannot be achieved without greatly changing the device configuration currently used.

In one known image forming apparatus, the user can replace any one of the image forming stations. In this manner, although an image forming engine provided with, for example, four image forming stations for the four basic colors of toner is used, an image using five or more colors of toner can be formed on a single side of a single recording medium. Therefore, with this image forming apparatus, an image can be formed using toner with a larger number of colors than the number of the image forming stations. In such an image forming apparatus, even though the image forming stations for the four basic colors described above are used, transparent toner and the like can be additionally used relatively easily. However, in this image forming apparatus, a series of operations including forming an image with additional color toner and fixation on a recording medium that has been subjected to fixation must be performed. In this method, a plurality of (two) fixing operations are performed on one image forming surface of a recording medium. Therefore, an amount of heat applied to the recording medium for fixing in image formation has been wasted, and the recording medium has been excessively warped and deformed because an excessively large amount of fixing heat has been supplied to the recording medium and a toner image. In addition, image abnormality such as abnormally high image gloss has occurred.

SUMMARY OF THE INVENTION

It is an object of the present invention to at least partially solve the problems in the conventional technology.

According to the present invention, there is provided an image forming apparatus including: a plurality of image forming stations each including at least a developing unit and a photosensitive element, the image forming stations forming an image forming engine; a transfer medium to which toner images visualized on the respective photosensitive elements by the respective developing units are transferred; and a fixing unit that performs a fixing operation to fix a transferred toner image on the transfer medium to a recording medium. A transparent toner can be used for any of the plurality of image forming stations. The image forming engine performs a plurality of times of toner image transferring on the transfer medium by performing transferring at least one toner image to the transfer medium from at least one of the image forming stations and by performing at least once transferring at least one toner image from at least one of the rest of the image forming stations. Thus, the toner images on the transfer medium are formed using a desired number of colors of toner including the transparent toner. The image forming apparatus further includes a control unit configured to change automatically or in accordance with a user's selection a transfer order of transferring the transparent toner from the image forming station using the transparent toner and a toner other than the transparent toner from the image forming station not using the transparent toner.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of the present invention will be described below with reference to the accompanying drawings.

Figure 1:
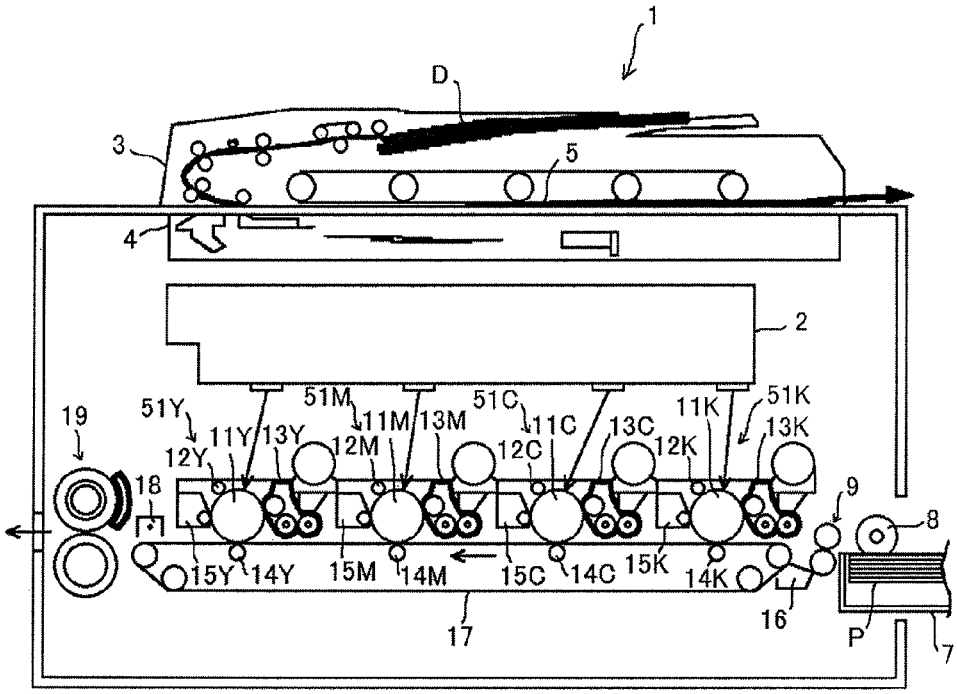
FIG. 1 is a schematic cross sectional view illustrating the schematic configuration of an example of a general electrophotographic image forming apparatus in which a recording medium is used as a medium to which an image is to be transferred.

FIG. 1 is a schematic cross sectional view of an example of a general electrophotographic image forming apparatus, and an example of a copying machine is illustrated as the example of the electrophotographic image forming apparatus to which the present invention can be applied. The image forming apparatus illustrated in FIG. 1 is an example of an image forming apparatus of the type in which toner images formed on photosensitive elements are transferred directly to a recording medium, i.e., an image forming apparatus in which the recording medium itself is used as a medium to which an image is transferred. However, the present invention is not limited to the above configuration.

In FIG. 1, reference numeral 1 denotes the body of the full-color copying machine used as the image forming apparatus. The image forming apparatus 1 includes: a writing unit 2 that emits laser beams based on input image information; an original reading unit 4 for reading original image information included in an original D; a contact glass 5 disposed above the original reading unit 4; and an original conveying-reading unit 3 disposed on top of the contact glass 5 to convey the original D. The image forming apparatus 1 illustrated in FIG. 1 further includes: an image forming engine including four image forming stations 51 (Y, M, C, and K) each including one drum-shaped photosensitive element 11 (Y, M, C, or K) and peripheral image forming components and the like; an endless conveying belt 17 that is disposed so as to abut on the surfaces of the four photosensitive elements 11 (Y, M, C, and K) at positions facing the photosensitive elements 11 (Y, M, C, and K) so as to be in internal (and/or external) contact with a plurality of rollers; and the like. The image forming apparatus 1 further includes: a paper feeding unit 7, being disposed in a lower portion of the image forming apparatus 1 and being drawn on the right side in the figure, that is used as a recording medium storage unit for storing a stack of recording media, such as recording sheets, to which toner images formed on the photosensitive elements 11 (Y, M, C, and K) are transferred; and a registration roller pair 9 disposed on the downstream side of the paper feeding unit 7 in the conveying direction of a recording medium P and used to adjust the timing of conveying the recording medium P.

A toner image of each of the four colors (yellow, magenta, cyan, and black) is formed on the corresponding photosensitive element of the four photosensitive elements 11 (Y, M, C, and K). Charging units 12 (Y, M, C, and K) for charging the respective surfaces of the photosensitive elements 11 (Y, M, C, and K), developing units 13 (Y, M, C, and K) for developing an electrostatic latent image formed on the respective photosensitive elements 11 (Y, M, C, and K), and cleaning units 15 (Y, M, C, and K) for collecting untransferred toner on the respective photosensitive elements 11 (Y, M, C, and K) are disposed around the corresponding photosensitive elements 11 (Y, M, C, and K). In addition, by interposing the conveying belt 17, transfer bias rollers 14 (Y, M, C, and K) are disposed at positions facing the photosensitive elements 11 (Y, M, C, and K).

Moreover, a fixing unit 19 for fixing the toner images formed on the photosensitive elements 11 (Y, M, C, and K) to a recording medium is disposed on the downstream side of the image forming engine in the conveying direction. When heat and pressure are applied, by the fixing unit 19, to a recording medium carrying a toner image, a not-yet-fixed toner image on the recording medium is fixed. The fixing unit 19 illustrated in the figures is a fixing unit of the electromagnetic induction heating type well-known to a person skilled in the art. The outline of an example of a fixing unit of the electromagnetic induction heating type will be described below. The fixing unit 19 includes, for example: a fixing roller provided with a thin fixing sleeve having a heat generating layer and the like being disposed on the outer circumference of a heat insulating elastic layer of the fixing roller; a pressure roller that is brought into pressure contact with the fixing roller to form a fixing nip; and an electromagnetic induction heating member that is closely disposed to and face the outer circumferential surface of the fixing roller to heat the fixing roller by electromagnetic induction. When a high-frequency alternating current is applied to the coil portion of the electromagnetic induction heating member, a magnetic flux that changes its direction alternately, i.e., an alternating magnetic field, is formed around the heat generating layer provided in the fixing sleeve and the like of the fixing roller. The alternating magnetic field generates an eddy current in the heat generating layer, and the heat generating layer and then the fixing roller are heated by the Joule heat generated by the electric resistance, in the heat generating layer, to the eddy current. The toner on a recording medium conveyed to the fixing nip is fused by the heat of the heated fixing roller. The fused toner is fixed to the recording medium by the pressure from the pressure roller (serving as a second portion of the fixing member) that is in pressure contact with the fixing roller (serving as a first portion of the fixing member) at the fixing nip, thereby a semipermanent image is formed.

Next, an image forming operation in the image forming apparatus 1 illustrated in FIG. 1 will be described. First, an original D having image information to be copied by the image forming apparatus 1 is conveyed from an original table by conveying rollers disposed in the original conveying-reading unit 3 as indicated by an arrow in FIG. 1 and is then placed on the contact glass 5 below which the original reading unit 4 is disposed. Then the image information of the original D placed on the contact glass 5 is optically scanned by the original reading unit 4. An example of the acquisition of the image information by the original reading unit 4 is as follows. The original reading unit 4 scans the original D on the contact glass 5 while the original D is irradiated with light emitted from an illuminating lamp. The light reflected by the original D is focused to form an image on a color sensor using appropriate optical members such as a group of mirrors and lenses. The information of the color image on the original D that is thus formed on the color sensor is read by the color sensor for each component of the color-separated light in the RGB (red, green, and blue) format and is then converted to electric image signals. Then color-separated image signals in the RGB format are subjected to color conversion processing, color correction processing, spatial frequency correction processing, and the like in an image processing unit to obtain color image information corresponding to each of the toner colors (yellow, magenta, cyan, and black).

The four photosensitive elements 11 (Y, M, C, and K) start to rotate in the clockwise direction in the plane of the figure. During the rotation, the surfaces of the photosensitive elements 11 (Y, M, C, and K) are uniformly charged by the corresponding charging units 12 (Y, M, C, and K). Laser beams (exposure beams) corresponding to the acquired image information for different toner colors of yellow, magenta, cyan, and black are emitted from the writing unit 2 to the uniformly charged photosensitive elements 11 (Y, M, C, and K) of the corresponding color, and electrostatic latent images of the corresponding toner colors are respectively formed on the photosensitive elements 11 (Y, M, C, and K).

The writing unit 2 includes four light sources corresponding to each of the four photosensitive elements 11 (Y, M, C, and K). The laser beams corresponding to the toner colors are emitted from the four light sources, respectively, as described above. Each of the laser beams emitted from the light sources is caused to scan the surface of the corresponding photosensitive element 11 (Y, M, C, or K) in the longitudinal direction along the axes of the photosensitive element 11 (Y, M, C, or K) (the direction perpendicular to the plane of FIG. 1) by, for example, being reflected by a polygon mirror rotating at high speed or a reflective mirror, thereby a desired electrostatic latent image is written on the photosensitive elements 11 (Y, M, C, and K) rotating in the clockwise direction in the plane of FIG. 1.

The photosensitive elements 11 (Y, M, C, and K) having the desired electrostatic latent images formed thereon are further rotated in the clockwise direction. When the images reach the developing units 13 (Y, M, C, and K), toner of the respective color, corresponding to the charge of each of the electrostatic latent images, is transferred to each of the photosensitive elements 11 (Y, M, C, and K), where each of the latent images is made visible.

After a recording medium, on which an image is to be formed, is fed from the paper feeding unit 7 disposed in the apparatus body 1, the recording medium is conveyed to the registration roller pair 9 that have not been driven to rotate yet. When the edge of the recording medium abuts on the registration roller nip formed by the registration roller pair 9, a so-called loop is formed, and the registration of the recording medium is made. The registered recording medium is conveyed toward the conveying belt 17 by the rotation of the registration roller pair 9 at the timing adjusted to the formation process of toner images formed on the photosensitive elements 11 (Y, M, C, and K). In a transfer unit formed by the photosensitive elements 11 (Y, M, C, and K) and the transfer bias rollers 14 (Y, M, C, and K) which are facing each other and between which the conveying belt 17 is interposed, the images are directly transferred to the recording medium, used as a medium to which an image is transferred, by applying a predetermined voltage, for example, to the transfer bias rollers 14 (Y, M, C, and K) during the conveyance of the recording medium. In this manner, the colored toner images formed on the respective photosensitive elements 11 (Y, M, C, and K) are successively superimposed one after another on the recording medium at the desired positions with proper timing from the upstream side of the conveying belt 17 in the conveying direction of the recording medium, thus forming a full-color image on the recording medium. The recording medium that carries the full-color image is further conveyed to the fixing unit 19 disposed on the downstream side in the conveying direction of the recording medium. Then heat and pressure are applied to the recording medium in the fixing unit 19, as described above, and a semipermanent image is fixed to the recording medium. Afterward, the recording medium is further conveyed to be ejected to a recording medium discharge unit such as a discharge tray.

Residual toner on the photosensitive elements 11 (Y, M, C, and K), after the toner images are transferred, are collected by the respective cleaning units 15 (Y, M, C, and K). Then the potentials on the photosensitive elements 11 (Y, M, C, and K) are initialized by charge removal units (not shown), and the series of image forming operations is completed.

Figure 2:
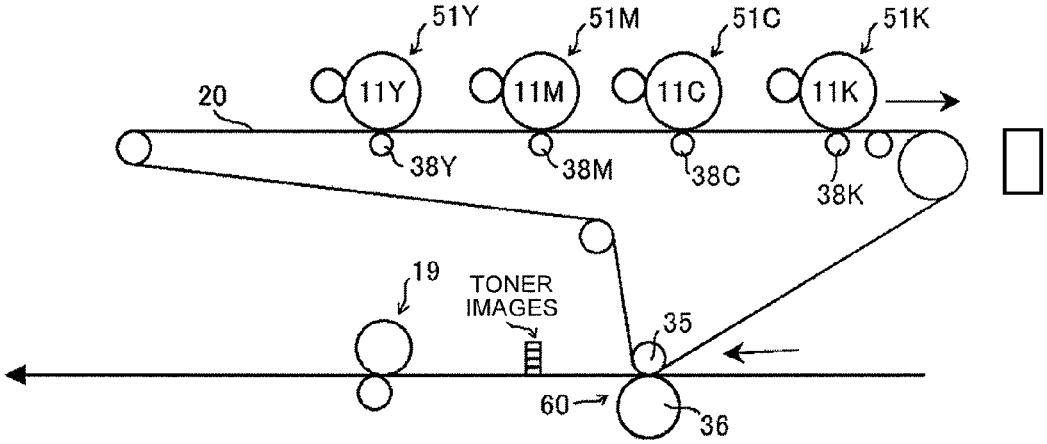
FIG. 2 is a schematic cross sectional view illustrating the schematic configuration of another example of a general electrophotographic image forming apparatus of the four-drum tandem type in which an intermediate transfer belt is used as medium to which an image is transferred.

Next, with reference to FIG. 2, description will be given of another configuration example of the image forming apparatus according to the present invention. FIG. 2 is a schematic cross sectional view of an image forming apparatus of the four-drum tandem type that includes image forming units using toner for yellow, magenta, cyan, and black (Y, M, C, and K). In FIG. 2, only a secondary transfer mechanism, formed by photosensitive elements 11 (Y, M, C, and K) and an intermediate transfer belt 20, and a fixing unit 19 are extracted and drawn. In the configuration of the image forming apparatus illustrated in FIG. 1 described above, the toner images formed on the photosensitive elements 11 (Y, M, C, and K) are directly transferred to a recording medium used as a medium to which an image is transferred. However, in the example of the image forming apparatus illustrated in FIG. 2, the intermediate transfer belt 20 is provided as a medium to which an image is transferred, and an image to be formed is transferred to a recording medium via the intermediate transfer belt. The configuration for forming toner images on the photosensitive elements 11 (Y, M, C, and K) is similar to that in the image forming apparatus illustrated in FIG. 1. Therefore, the following description will be devoted mainly to the processes related to the toner images after being formed on the photosensitive elements until being carried by a recording medium.

In the image forming apparatus illustrated in FIG. 2, the toner images formed on the photosensitive elements 11 (Y, M, C, and K) are primary-transferred to the intermediate transfer belt 20 that is an endless belt running around, by being in internal (and/or external) contact with, a plurality of rollers. Primary transfer rollers 38 (Y, M, C, and K) are disposed on the inner side of the intermediate transfer belt 20 facing the respective photosensitive elements 11 (Y, M, C, and K) with the intermediate transfer belt 20 interposed therebetween. The primary transfer rollers 38 (Y, M, C, and K) abut on the back side of the intermediate transfer belt 20 to form an appropriate primary transfer nips between the intermediate transfer belt 20 and the photosensitive elements 11 (Y, M, C, and K), respectively. A transfer voltage with a polarity opposite to the toner charging polarity for the toner images formed on the photosensitive elements 11 (Y, M, C, and K) is applied to the primary transfer rollers 38 (Y, M, C, and K). Transfer electric fields are formed accordingly between the intermediate transfer belt 20 and the photosensitive elements 11 (Y, M, C, and K), and the toner images on the photosensitive elements 11 (Y, M, C, and K) are primary-transferred in an electrostatic manner to the intermediate transfer belt 20 that is driven to rotate in synchronization with the photosensitive elements 11 (Y, M, C, and K). The color toner images formed on the respective photosensitive elements 11 (Y, M, C, and K) are superimposed one another on the intermediate transfer belt 20 sequentially at proper timing from the upstream side of the intermediate transfer belt 20 in the conveying direction of the recording medium, thereby a full-color toner image is formed on the intermediate transfer belt 20.

On the other hand, a registered recording medium on standby by forming a so-called loop with a registration roller pair 9 not illustrated in FIG. 2 is conveyed by the rotation of the registration roller pair 9 at the timing adjusted in association with the formation of the full-color toner image on the intermediate transfer belt 20 by a sequence of primary transfers. In a secondary transfer unit 60 formed by a secondary transfer roller 35 around which the intermediate transfer belt 20 is running and a counter roller 36 facing the secondary transfer roller 35 with the intermediate transfer belt 20 interposed therebetween, a predetermined voltage is applied, for example, to the counter roller 36 so as to secondary-transfer the image to the recording medium. The recording medium, on which the image has been secondary transferred, is further conveyed to the fixing unit 19 disposed on the downstream side of the recording medium in the conveying direction. Then, heat and pressure are applied to the recording medium in the fixing unit 19, thereby a semipermanent image is fixed to the recording medium. The recording medium is further conveyed to be ejected to a recording medium discharge unit such as a discharge tray. Residual toner on the photosensitive elements 11 (Y, M, C, and K) after the image transfer are collected by cleaning units 15 (Y, M, C, and K), and then the potentials on the photosensitive elements 11 (Y, M, C, and K) are initialized by the charge removal units (not shown) in the same way as in the example illustrated in FIG. 1.

Figure 3:
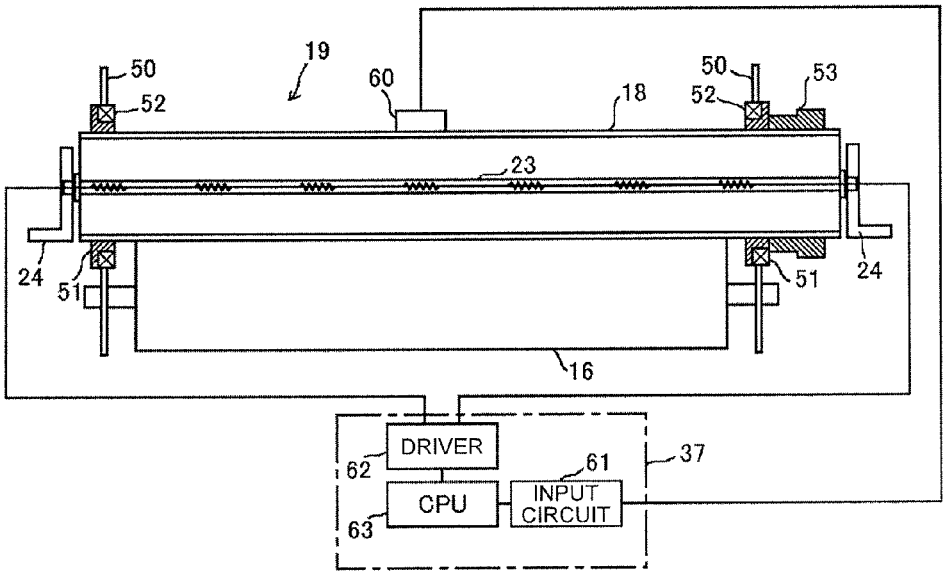
FIG. 3 is a schematic diagram illustrating an example of a general fixing unit of the internal heating type, the schematic diagram being a cross sectional view in the longitudinal direction of the fixing unit.
Figure 4:
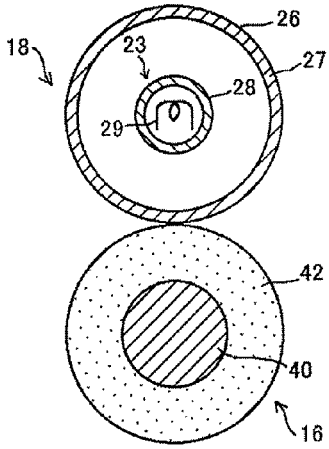
FIG. 4 is a diagram illustrating an example of the general fixing unit of the internal heating type, the diagram showing cross sections of a fixing roller and a pressure roller in the fixing unit.

The fixing unit 19 illustrated in FIG. 2 includes heating rollers (fixing rollers) and pressure rollers. The fixing unit 19 has a heating source provided in each of the heating rollers, and the heating method of the heating sources for the heating rollers is different from that in the fixing unit of the so-called electromagnetic induction heating type illustrated in FIG. 1. An example of the fixing unit of the internal heating type illustrated in FIG. 2 will be described with reference to FIGS. 3 and 4. As illustrated in FIGS. 3 and 4, this fixing unit includes a heating roller 18 and a pressure roller 16 that is pressed against the heating roller 18 by the urging force of an urging member (not shown) such as a spring. The heating roller 18 is attached to a pair of fixing side plates 50 disposed on the body of the image forming apparatus 1 via a pair of heat-insulating bushes 51 and a pair of bearings 52 and is driven to rotate by a gear 53 that is engaged with a driving source (not shown) directly or indirectly via a gear, a pulley, and the like. A radiant heater 23 is provided inside the heating roller 18, and the ends of the radiant heater 23 are held by heater holding members 24. A signal detected by a temperature sensor 65, abutting on the surface of the heating roller 18, is transmitted to a central processing unit (CPU) 63 through an input circuit 61. The CPU 63 is configured to control the power supply to the radiant heater 23 through a driver 62 based on the temperature of the heating roller 18 detected by the temperature sensor 65. Usually, when power is supplied to the image forming apparatus, electric current flows into the radiant heater 23 through the driver 62, and the temperature of the surface of the heating roller 18 rapidly increases to a predetermined temperature of around 180° C. As shown in FIG. 4, the heating roller 18 includes, as the border brim, a metal-made (aluminum-made) thin pipe 27 made of aluminum which is a metal, with an outer diameter of 40 mm and a thickness of 0.4 mm, for example. Generally, a fluorine-based surface release layer 26 is formed on the outer surface of the heating roller 18 so that the recording medium can be released easily from the heating roller 18 after the fixation. In addition, the pressure roller 16 includes a metal core 40 and a foamed silicon rubber layer 42 used as an elastic material. The radiant heater 23 is configured such that a tungsten filament 29 is placed inside a glass tube 28. The glass tube 28 is filled at least with inert gas and, as necessary, filled with nitrogen gas for preventing oxidation of the tungsten filament 29, a halogen material including iodine, bromine, chlorine, or the like.

Next, a description will be given of an example of the method to manufacture (dry) two-component toner (including transparent toner) used in an electrophotographic image forming apparatus to which the present invention described so far is applied. The polymerized toner manufactured by Ricoh is used as examples of the two-component toner produced by the method of production to be described below. However, the toner described here is an example, and toner that can be used in the present invention is not limited the toner produced by the method of production described below.

Dry two-component toner is the toner obtained by dispersing at least a polyester prepolymer having a functional group including a nitrogen atom, polyester, a colorant, and a release agent in an organic solvent to prepare a toner material solution which is then subjected to cross-linking reaction and/or elongation in a water-based solvent. The constituent materials of, and the method of manufacturing, the two-component toner will be described below.

Polyester

Polyester is obtained by a polycondensation reaction of a polyhydric alcohol compound and a polycarboxylic acid compound. Examples of the polyhydric alcohol compound (PO) include a dihydric alcohol (DIO) and a trihydric or higher polyhydric alcohol (TO). A single dihydric alcohol (DIO) or a mixture of a dihydric alcohol (DIO) and a small amount of a trihydric or higher polyhydric alcohol (TO) is preferred for the polycondensation reaction. Examples of the dihydric alcohol (DIO) include alkylene glycols (ethylene glycol, 1,2-propylene glycol, 1,3-propylene glycol, 1,4-butanediol, 1,6-hexanediol, and the like); alkylene ether glycols (diethylene glycol, triethylene glycol, dipropylene glycol, polyethylene glycol, polypropylene glycol, polytetramethylene ether glycol, and the like); alicyclic diols (1,4-cyclohexane dimethanol, hydrogenated bisphenol A, and the like); bisphenols (bisphenol A, bisphenol F, bisphenol S, and the like); alkylene oxide (ethylene oxide, propylene oxide, butylene oxide, and the like) adducts of the above-listed alicyclic diols; and alkylene oxide (ethylene oxide, propylene oxide, butylene oxide, and the like) adducts of the above-listed bisphenols. Of these, alkylene glycols having 2 to 12 carbon atoms and alkylene oxide adducts of bisphenols are preferred, and alkylene oxide adducts of bisphenols and combinations of alkylene oxide adducts of bisphenols and alkylene glycols having 2 to 12 carbon atoms are particularly preferred. Examples of the trihydric or higher polyhydric alcohol (TO) include: trihydric to octahydric and higher polyhydric aliphatic alcohols (glycerin, trimethylolethane, trimethylolpropane, pentaerythritol, sorbitol, and the like); tris or higher phenols (trisphenol PA, phenol novolac, cresol novolac, and the like); and alkylene oxide adducts of the above-listed tris or higher phenols.

Examples of the polycarboxylic acid (PC) include dicarboxylic acids (DIC) and tricarboxylic or higher polycarboxylic acids (TC). A single dicarboxylic acid (DIC) or a mixture of a dicarboxylic acid (DIC) and a small amount of a tricarboxylic or higher polycarboxylic acid (TC) is preferred. Examples of the dicarboxylic acid (DIC) include: alkylene dicarboxylic acids (succinic acid, adipic acid, sebacic acid, and the like); alkenylene dicarboxylic acids (maleic acid, fumaric acid, and the like); and aromatic carboxylic acids (phthalic acid, isophthalic acid, terephthalic acid, naphthalene dicarboxylic acid, and the like). Of these, alkenylene dicarboxylic acids having 4 to 20 carbon atoms and aromatic dicarboxylic acids having 8 to 20 carbon atoms are preferred. Examples of the tricarboxylic or higher polycarboxylic acids (TC) include aromatic polycarboxylic acids having 9 to 20 carbon atoms (trimellitic acid, pyromellitic acid, and the like). Note that an acid anhydride or a lower alkyl ester (such as methyl ester, ethyl ester, and isopropyl ester) of any of the above exemplified polycarboxylic acids (PC) can be used to react with the polyhydric alcohol (PO).

The ratio of the polyhydric alcohol (PO) to the polycarboxylic acid (PC), in terms of the equivalent ratio [OH]/[COOH] of the hydroxyl groups (OH) to the carboxyl groups (COOH), is normally 2/1 to 1/1, preferably 1.5/1 to 1/1, and more preferably 1.3/1 to 1.02/1. The polycondensation reaction of the polyhydric alcohol (PO) and the polycarboxylic acid (PC) is performed under heating at 150 to 280° C. in the presence of a known esterification catalyst such as tetrabutoxy titanate or dibutyltin oxide while pressure is reduced as necessary and water generated accordingly is removed by evaporation to obtain polyester having a hydroxyl group. The hydroxyl value of the polyester is preferably 5 or larger. The acid value of the polyester is normally 1 to 30 and preferably 5 to 20. The acid value given allows the toner to be negatively charged easily. In addition, the affinity between the toner and a recording sheet in fixing the toner to the recording sheet improves, thereby improving the low-temperature capability of fixation. However, if the acid value exceeds 30, the stability of charges, particularly against the environmental variations, tends to deteriorate. The weight-average molecular weight of the polyester is 10,000 to 400,000 and preferably 20,000 to 200,000. A weight-average molecular weight of smaller than 10,000 is not preferred because the offset resistance deteriorates. A weight-average molecular weight exceeding 400,000 is also not preferred because the low-temperature capability of fixation deteriorates.

The polyester preferably contains urea-modified polyester in addition to the unmodified polyester obtained by the above polycondensation reaction. The urea-modified polyester is obtained as follows. First, a polyester prepolymer (A) having an isocyanate group is obtained by reacting a polyisocyanate compound (PIC) with a carboxyl group, a hydroxyl group, and the like at an end of the polyester obtained by the polycondensation reaction described above. Then the obtained polyester prepolymer (A) is reacted with an amine to cross-link and/or elongate the molecular chain. Examples of the polyisocyanate compound (PIC) include: aliphatic polyisocyanates (tetramethylene diisocyanate, hexamethylene diisocyanate, 2,6-diisocyanatomethyl caproate, and the like); alicyclic polyisocyanates (isophorone diisocyanate, cyclohexyl methane diisocyanate, and the like); aromatic diisocyanates (tolylene diisocyanate, diphenyl methane diisocyanate, and the like); aromatic aliphatic diisocyanates ($\alpha,\alpha,\alpha',\alpha'$-tetramethyl xylylene diisocyanate and the like); isocyanates; compounds obtained by blocking the above polyisocyanates with phenol derivatives, oximes, caprolactam, and the like; and combinations of two or more of the above compounds. The ratio of the polyisocyanate compound (PIC), in terms of the equivalent ratio [NCO]/[OH] of the isocyanate groups [NCO] to the hydroxyl groups [OH] in the polyester having the hydroxyl groups, is normally 5/1 to 1/1, preferably 4/1 to 1.2/1, and more preferably 2.5/1 to 1.5/1. If the equivalent ratio [NCO]/[OH] exceeds 5, the low-temperature capability of fixation deteriorates. When a urea-modified polyester is used, if the mole ratio of [NCO] is smaller than 1, the amount of urea in the ester becomes low, and therefore the hot offset resistance deteriorates. The amount of the polyisocyanate compound (PIC) component in the polyester prepolymer (A) having an isocyanate group is normally 0.5 to 40% by weight, preferably 1 to 30% by weight, and more preferably 2 to 20% by weight. If the amount is less than 0.5% by weight, the hot offset resistance deteriorates, and it is disadvantageous in achieving the compatibility between the heat-resistant storage properties and the low-temperature capability of fixation. If the amount exceeds 40% by weight, the low-temperature capability of fixation deteriorates. The number of isocyanate groups contained in a molecule of the polyester prepolymer (A) having an isocyanate group is normally 1 or larger, preferably 1.5 to 3 on an average, and more preferably 1.8 to 2.5 on an average. When the number in a molecule is smaller than 1, the molecular weight of the urea-modified polyester becomes low, and the hot offset resistance deteriorates.

Next, examples of the amines (B) which are allowed to react with the polyester prepolymer (A) include diamine compounds (B1), triamines or higher polyamine compounds (B2), amino alcohols (B3), amino mercaptans (B4), amino acids (B5), and compounds (B6) in which amino groups from B1 to B5 are blocked.

Examples of the diamine compounds (B1) include aromatic diamines (phenylene diamine, diethyl toluene diamine, 4,4'-diamine diphenyl methane, and the like), alicyclic diamines (4,4'-diamino-3,3'-dimethyl dicyclohexyl methane, diamine cyclohexane, isophorone diamine, and the like), and aliphatic diamines (ethylene diamine, tetramethylene diamine, hexamethylene diamine, and the like). Examples of the triamines or higher polyamine compounds (B2) include diethylene triamine and triethylene tetramine. Examples of the amino alcohols (B3) include ethanolamine and hydroxyethyl aniline. Examples of the amino mercaptans (B4) include aminoethyl mercaptan and aminopropyl mercaptan. Examples of the amino acids (B5) include aminopropionic acid and aminocaproic acid. Examples of the compounds (B6) in which the amino groups of B1 to B5 are blocked include ketimine compounds and oxazolidine compounds, which are obtained from the above amines B1 to B5 and ketones (acetone, methyl ethyl ketone, methyl isobutyl ketone, and the like). Among the amines (B), the diamine compounds of B1 and mixtures of B1 and a small amount of B2 are preferable.

A ratio of the amines (B), which is expressed as an equivalent ratio (NCO)/(NHx) of an isocyanate group (NCO) from the polyester prepolymer (A) that has the isocyanate group to an amino group (NHx) from the amines (B), is normally 1/2 to 2/1, preferably 1.5/1 to 1/1.5, and more preferably 1.2/1 to 1/1.2. If the ratio (NCO)/(NHx) becomes greater than 2 or smaller than 1/2, the molecular weight of the urea-modified polyester is reduced and the anti-offset ability of the toner deteriorates.

The urea-modified polyester may also have urethane bonds along with urea bonds. A mole ratio of a content of the urea bonds and a content of the urethane bonds is normally 100/0 to 10/90, preferably 80/20 to 20/80, and more preferably 60/40 to 30/70. If the molar ratio of the urea bonds is less than 10%, the anti-offset ability of the toner deteriorates.

The urea-modified polyester is produced by a one-shot method or the like. The polyhydric alcohol (PO) and the polycarboxylic acid (PC) are heated to 150 to 280° C. in the presence of a known esterification catalyst such as tetrabutoxy titanate or dibutyltin oxide, and water generated during a reaction is removed by evaporation as necessary under reduced pressure to obtain polyester having a hydroxyl group. Then the polyester is reacted with polyisocyanate (PIC) at 40 to 140° C. to obtain a polyester prepolymer (A) having an isocyanate group. The polyester prepolymer (A) is further reacted with the amine (B) at 0 to 140° C. to obtain urea-modified polyester.

During the reaction with the polyisocyanate (PIC) and during the reaction of the polyester prepolymer (A) with the amine (B), a solvent may be used as necessary. The solvent that can be used is inactive to the isocyanate (PIC), and examples of such a solvent include: aromatic solvents (toluene, xylene, and the like); ketones (acetone, methyl ethyl ketone, methyl isobutyl ketone, and the like); esters (ethyl acetate and the like); amides (dimethyl formamide, dimethyl acetamide, and the like); and ethers (tetrahydrofuran), and the like. A reaction terminator may be used as necessary for the cross-linking and/or the elongation reaction of the polyester prepolymer (A) and the amine (B) to adjust the molecular weight of the obtained urea-modified polyester. Examples of the reaction terminator include monoamines (diethylamine, dibutylamine, butylamine, laurylamine, and the like) and compounds (ketimine compounds) obtained by blocking the monoamines. The weight-average molecular weight of the urea-modified polyester is normally 10,000 or larger, preferably 20,000 to 10,000,000, and more preferably 30,000 to 1,000,000. If the weight-average molecular weight is smaller than 10,000, the hot offset resistance deteriorates. When the unmodified polyester described above is used, the number-average molecular weight of the urea-modified polyester is not particularly limited, and the urea-modified polyester may have any number-average molecular weight so long as the weight-average molecular weight described above can be easily obtained. When only the urea-modified polyester is used, the number-average molecular weight thereof is normally 2,000 to 15,000, preferably 2,000 to 10,000, and more preferably 2,000 to 8,000. If the number-average molecular weight exceeds 20,000, the low-temperature capability of fixation and the gloss when the toner is used in a full-color apparatus deteriorate.

Concomitant use of the unmodified polyester and the urea-modified polyester can improve the low-temperature capability of fixation and the gloss in using the toner in a full-color image forming apparatus and is therefore preferred to the use of the urea-modified polyester alone. The unmodified polyester may contain polyester modified with a chemical bond other than the urea bond. It is preferable in terms of low-temperature capability of fixation and hot offset resistance that the unmodified polyester and the urea-modified polyester be at least partially compatible with each other. Therefore, preferably, the unmodified polyester and the urea-modified polyester have a similar composition to each other. The weight ratio of the unmodified polyester to the urea-modified polyester is normally 20/80 to 95/5, preferably 70/30 to 95/5, more preferably 75/25 to 95/5, and particularly preferably 80/20 to 93/7. If the weight ratio of the urea-modified polyester to the unmodified polyester is less than 5%, the hot offset resistance deteriorates, and it is disadvantageous in achieving the compatibility between the heat-resistant storage properties and the low-temperature capability of fixation.

The glass transition temperature (Tg) of a binder resin containing the unmodified polyester and the urea-modified polyester is normally 45° C. to 65° C. and preferably 45° C. to 60° C. If the glass transition temperature is less than 45° C., the heat resistance of the toner deteriorates. If the glass transition temperature exceeds 65° C., the low temperature capability of fixation of the toner becomes insufficient. The urea-modified polyester is likely to be present on the surface of parent toner particles to be obtained. Therefore, even if the glass transition temperature is low, the toner shows better tendency in the heat-resistant storage properties than publicly known polyester-based toner does.

Colorant

Any publicly known dye or pigment can be used as the colorant. Examples of the usable colorant include carbon black, nigrosine dye, iron black, naphthol yellow S, Hansa yellow (10G, 5G, G), cadmium yellow, yellow iron oxide, yellow ocher, chrome yellow, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazine lake, quinoline yellow lake, anthrazan yellow BGL, isoindolinone yellow, iron red, minium, red lead, cadmium red, cadmium mercury red, antimony vermilion, permanent red 4R, para red, fire red, para chloro ortho nitro aniline red, lithol fast scarlet G, brilliant fast scarlet, brilliant carmine BS, permanent red (F2R, F4R, FRL, FRLL, F4RH), fast scarlet VD, vulcan fast rubine B, brilliant scarlet G, lithol rubine GX, permanent red FSR, brilliant carmine 6B, pigment scarlet 3B, bordeaux 5B, toluidine maroon, permanent bordeaux F2K, helio bordeaux BL, bordeaux 10B, BON maroon light, BON maroon medium, eosine lake, rhodamine lake B, rhodamine lake Y, alizarin Lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS, BC), indigo, ultramarine blue, Prussian blue, anthraquinone blue, fast violet B, methyl violate lake, cobalt purple, manganese purple, dioxane violate, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc white, lithopone, and mixtures thereof. The colorant content, as compared to the toner content, is normally 1 to 15% by weight and preferably 3 to 10% by weight.

The colorant can be used as a masterbatch combined with a resin. Examples of the binder resin used for manufacturing the masterbatch or kneaded with the masterbatch include, polymers of styrene and its substitution products such as polystyrene, poly-p-chlorostyrene, and polyvinyl toluene, copolymers of styrene and its substitution products with vinyl compounds, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic resin, rosin, modified rosin, terpene resin, aliphatic or alicyclic hydrocarbon resin, aromatic petroleum resin, chlorinated paraffin, and paraffin wax. These binder resins may be used alone or in mixture. When transparent toner is produced, it is sufficient to omit the colorant listed above.

Charge Control Agent

Any publicly known charge control agent can be used. Examples of the charge control agent include nigrosine dyes, triphenylmethane dyes, chromium-containing metal complex dyes, molybdic acid chelate pigments, rhodamine dyes, alkoxyamines, quaternary ammonium salts (including fluorine-modified quaternary ammonium salts), alkylamides, phosphor and compounds thereof, tungsten and compounds thereof, fluorine-based activators, metal salts of salicylic acid, and metal salts of salicylic acid derivatives. Specific examples include BONTRON 03 (nigrosine dye), BONTRON P-51 (quaternary ammonium salt), BONTRON S-34 (metal-containing azo dye), E-82 (oxynaphthoic acid-based metal complex), E-84 (salicylic acid-based metal complex), and E-89 (phenolic condensation product) (these are products of Orient Chemical Industries Co., Ltd.), TP-302 and TP-415 (molybdenum complexes of quaternary ammonium salts) (products of Hodogaya Chemical Co., Ltd.), COPY CHARGE PSY VP2038 (quaternary ammonium salt), COPY BLUE PR (triphenylmethane derivative), COPY CHARGE NEG VP2036 and NX VP434 (quaternary ammonium salts) (these are products of Hoechst AG), LRA-901, LR-147 (boron complex) (products of Japan Carlit Co., Ltd.), copper phthalocyanine, perylene, quinacridone, azo-based pigments, and polymer compounds having a functional group such as a sulfonic group, a carboxyl group, or a quaternary ammonium salt. Of these, materials that can control the toner to have a negative polarity are particularly preferably used.

The amount of the charge control agent to be used is determined based on the type of the binder resin, the presence or absence of additives used as necessary, and the method of manufacturing the toner (including the dispersing method) and is not restricted to a fixed amount. The amount to be used is preferably in the range of 0.1 to 10 parts by weight for 100 parts by weight of the binder resin. Preferably, the range of the amount to be used should be 0.2 to 5 parts by weight. If the amount exceeds 10 parts by weight, the charging property of the toner is too large, causing a reduction in the effect of the charge control agent and an increase in the electrostatic suction force between the toner and a developing roller, resulting in a reduction in the flowability of a developer and a reduction in the density of an image.

Release Agent

The release agent comprises a low-melting point wax having a melting point of 50 to 120° C., and the wax dispersed in the binder resin functions at the interface between the fixing roller and the toner more effectively as the release agent, and this can effectively prevent high-temperature offset without applying an oily release agent to the fixing roller. Examples of such a wax component include the following: vegetable waxes such as carnauba wax, cotton wax, Japan wax, and rice wax; animal waxes such as beeswax and lanolin; mineral waxes such as ozokerite and ceresin; and petroleum waxes such as paraffin, microcrystalline wax, and petrolatum. Examples other than the above natural waxes include: synthetic hydrocarbon waxes such as Fisher-Tropsch wax and polyethylene wax; and synthetic waxes such as esters, ketones, and ethers. Other examples of the usable wax include: fatty acid amides such as 12-hydroxystearic acid amide, stearic acid amide, anhydrous phthalic acid imide, and chlorinated hydrocarbons; low-molecular-weight crystalline polymer resins such as acrylate homopolymers (for example, poly-n-stearyl methacrylate and poly-n-lauryl methacrylate) and acrylate-based copolymers (for example, n-stearyl acrylate-ethyl methacrylate copolymers); and crystalline polymers having a long alkyl group as a side chain. The charge control agent and the release agent may be melted and kneaded with the masterbatch and the binder resin or, of course, added when they are dissolved and dispersed in an organic solvent.

External Additive

Inorganic fine particles are preferably used as an external additive for improving the fluidity, developability and charging capability of the toner. The primary particle diameter of the inorganic particles is preferable in the range $5\times10^{-3}$ to 2 μm and particularly preferable in the range $5\times10^{-3}$ to 0.5 μm. The specific surface area, according to the Brunauer-Emmett-Teller (BET) theory, of the inorganic particles is preferably 20 to 500 $m^2/g$. The ratio of the inorganic particles used to the toner is preferably 0.01 to 5% by weight and particularly preferably 0.01 to 2.0% by weight. Specific examples of the inorganic fine particles include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, iron red, antimony trioxide, magnesium oxide, zirconium oxide, barium sulfate, barium carbonate, calcium carbonate, silicon carbide, and silicon nitride. Particularly preferred for a fluidity-imparting agent is the concomitant use of the fine particles of hydrophobic silica and hydrophobic titanium. When the two types of the fine particles having an average particle diameter of $5\times10^{-2}$ μm or smaller are used for mixing and stirring, the electrostatic force and van der Waals force between these particles and the toner are significantly improved. Therefore, even during stirring and mixing performed inside a developing unit to obtain the desired charge level, the fluidity-imparting agent is not separated from the toner, so that high image quality without a void can be obtained and the amount of the residual toner after transfer can be reduced. Although the fine particles of titanium oxide have good environmental stability and image density stability, there is a tendency that the rising characteristics of charging within ten minutes after starting charging deteriorate. Therefore, if the added amount of the fine particles of titanium oxide is larger than that of the fine particles of silica, the above side effect may become significant. However, when the added amount of the fine particles of hydrophobic silica and the fine particles of hydrophobic titanium oxide is in the range of 0.3 to 1.5% by weight, the rising characteristics of charging are not largely impaired, and the desired rising characteristics of charging are obtained. More specifically, stable image quality can be obtained even after a copying operation is repeated.

A method of manufacturing the toner will next be described. A preferred manufacturing method will be described below. However, as described above, the present invention is not limited thereto.

Toner Manufacturing Method (1) A colorant, an unmodified polyester, a polyester prepolymer having an isocyanate group, and a release agent are dispersed in an organic solvent to prepare a toner material solution.

A volatile organic solvent having a boiling point of less than 100° C. is preferably used because the organic solvent can be easily removed after formation of parent toner particles. More specifically, any of toluene, xylene, benzene, carbon tetrachloride, ethylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, and the like may be used alone or in combination with two or more thereof. In particular, aromatic solvents such as toluene and xylene and halogenated hydrocarbons such as methylene chloride, 1,2-dichloroethane, chloroform, and carbon tetrachloride are preferred. The amount of the organic solvent used is normally 0 to 300 parts by weight based on 100 parts by weight of the polyester prepolymer, preferably 0 to 100 parts by weight, and more preferably 25 to 70 parts by weight.

2) The toner material solution is emulsified in an aqueous solvent in the presence of a surfactant and resin particles.

The aqueous solvent may be water alone or may include organic solvents such as alcohols (methanol, isopropyl alcohol, ethylene glycol, and the like), dimethyl formamide, tetrahydrofuran, cellosolves (methyl cellosolve, and the like), and lower ketones (acetone, methyl ethyl ketone, and the like).

An amount of use of the aqueous solvent is normally 50 to 2,000 parts by weight, and preferably 100 to 1,000 parts by weight of the aqueous solvent with respect to 100 parts by weight of the toner material solution. If the amount of use of the aqueous solvent becomes less than 50 parts by weight, the dispersed state of the toner material solution deteriorates and toner particles of a predetermined particle diameter cannot be obtained. If the amount of use of the aqueous solvent exceeds 20,000 parts by weight, toner manufacturing is not economical.

Further, a dispersing agent such as a surfactant or resin particles is suitably added for enhancing dispersion in the aqueous solvent. Examples of the surfactant include anionic surfactants such as alkylbenzene sulfonate, α-olefin sulfonate and ester phosphate; cationic surfactants of amine salt type such as alkylamine salts, amino alcohol fatty acid derivatives, polyamine fatty acid derivatives and imidazoline; cationic surfactants of quaternary ammonium salt type such as alkyl trimethyl ammonium salt, dialkyldimethyl ammonium salt, alkyldimethylbenzyl ammonium salt, pyridinium salt, alkyl isoquinolium salt and chlorobenzetonium; nonionic surfactants such as fatty acid amide derivatives and polyhydric alcohol derivatives; and zwitterionic surfactants such as alanine, dodecyldi(aminoethyl) glycine, di(octylaminoethyl) glycine and N-alkyl-N,N-dimethyl ammonium betaine.

Use of the surfactant having a fluoroalkyl group enables to enhance the effect of the surfactant with a very small amount of the surfactant. Examples of preferably used anionic surfactants having a fluoroalkyl group include fluoroalkyl carboxylic acids having 2 to 10 carbon atoms and metal salts thereof, perfluorooctane sulfonyl disodium glutamate, 3-[ω-fluoroalkyl(C6 to C11)oxy]-1-alkyl(C3 to C4) sodium sulfonate, 3-[ω-fluoroalkanoyl(C6 to C8)-N-ethylamino]-1-propane sodium sulfonate, fluoroalkyl(C11 to C20) carboxylic acid and metal salts thereof, perfluoroalkyl carboxylic acid(C7 to C13) and metal salts thereof, perfluoroalkyl(C4 to C12)sulfonic acid and metal salts thereof, perfluorooctane sulfonic acid diethanol amide, N-propyl-N-(2-hydroxyethyl)perfluorooctane sulfonamide, perfluoroalkyl (C6 to C10)sulfonamide propyltrimethyl ammonium salt, perfluoroalkyl(C6 to C10)-N-ethylsulfonyl glycine salt, monoperfluoroalkyl(C6 to C16) ethyl phosphoric acid ester, and the like. Examples of product names thereof include Surflon S-111, S-112, and S-113 (manufactured by Asahi Glass Co.), Fluorad FC-93, FC-95, FC-98, and FC-129 (manufactured by Sumitomo 3M Ltd.), Unidyne DS-101 and DS-102 (manufactured by Daikin Industries Ltd.), Megaface F-110, F-120, F-113, F-191, F-812, and F-833 (manufactured by Dainippon Ink and Chemicals, Inc.), ECTOP EF-102, 103, 104, 105, 112, 123A, 123B, 306A, 501, 201, and 204 (manufactured by Tohkem Products Co.), Futargent F-100 and F-150 (manufactured by Neos Co.), and the like.

Examples of the cationic surfactant include primary or secondary aliphatic amines having a fluoroalkyl group, aliphatic quaternary ammonium salts such as perfluoroalkyl (C6 to C10) sulfonamide propyltrimethyl ammonium salt, benzalkonium salt, benzetonium chloride, pyridinium salt, and imidazolium salt. Examples of product names thereof include Surflon S-121 (manufactured by Asahi Glass Co.), Fluorad FC-135 (manufactured by Sumitomo 3M Ltd.), Unidyne DS-202 (manufactured by Daikin Industries Ltd.), Megaface F-150 and F-824 (manufactured by Dainippon Ink and Chemicals, Inc.), ECTOP EF-132 (manufactured by Tohkem Products Co.), and Futargent F-300 (manufactured by Neos Co.), and the like.

The resin particles are added for stabilizing the parent toner particles that are formed in the aqueous solvent. To stabilize the parent toner particles, the resin particles are preferably added such that a surface coverage of the resin particles on the surface of the parent toner particles is in a range of 10 to 90%. Examples of the resin particles include methyl polymethacrylate particles of 1 μm and 3 μm, polystyrene particles of 0.5 μm and 2 μm, poly(styrene-acrylonitrile) particles of 1 μm, and the like. Examples of product names thereof include PB-200H (manufactured by Kao Corp.), SGP (manufactured by Soken Co.), Technopolymer-SB (manufactured by Sekisui Plastics Co.), SGP-3G (manufactured by Soken Co.), Micropearl (manufactured by Sekisui Fine Chemicals Co.), and the like. Further, dispersing agents of inorganic compounds such as tricalcium phosphate, calcium carbonate, titanium oxide, colloidal silica, hydroxyapatite, and the like may also be used.

By using a polymeric protecting colloid, dispersion droplets of the above resin particles may also be stabilized as a dispersing agent that may be used in combination with the inorganic compound dispersing agent. Examples of the polymeric protecting colloids that may be used include acids such as acrylic acid, methacrylic acid, α-cyanoacrylic acid, α-cyanomethacrylic acid, itaconic acid, crotonic acid, fumaric acid, maleic acid and maleic anhydride; methacrylic monomers that have a hydroxyl group, for example, acrylic acid-β-hydroxyethyl, methacrylic acid-β-hydroxyethyl, acrylic acid-β-hydroxypropyl, methacrylic acid-β-hydroxypropyl, acrylic acid-γ-hydroxypropyl, methacrylic acid-γ-hydroxypropyl, acrylic acid-3-chloro-2-hydroxypropyl, methacrylic acid-3-chloro-2-hydroxypropyl, diethylene glycol monoacrylic acid ester, diethylene glycol monomethacrylic acid ester, glycerin monoacrylic acid ester, glycerin monomethacrylic acid ester, N-methylol acrylic amide, N-methylol methacrylic amide, and the like; vinyl alcohol or ethers with vinyl alcohol, for example, vinyl methyl ether, vinyl ethyl ether, vinyl propyl ether, and the like; esters of a vinyl alcohol and a compound having a carboxyl group, for example, vinyl acetate, vinyl propionate, vinyl butyrate, and the like; acrylic amide, methacrylic amide, diacetone acrylic amide or methylol compounds thereof; acid chlorides such as acryloyl chloride and methacroyl chloride, nitrogen-containing compounds such as vinyl pyridine, vinyl pyrrolidone, vinyl imidazole and ethylene imine; or heterocyclic homopolymers or copolymers thereof; polyoxyethylenes such as polyoxyethylene, polyoxypropylene, polyoxyethylene alkylamine, polyoxypropylene alkyl amine, polyoxyethylene alkyl amide, polyoxypropylene alkyl amide, polyoxyethylene nonylphenyl ether, polyoxyethylene laurylphenyl ether, polyoxyethylene stearylphenyl ester and polyoxyethylene nonylphenyl ester; and celluloses such as methyl cellulose, hydroxyethyl cellulose, hydroxypropyl cellulose, and the like.

The dispersion method is not limited to any specific methods, and commonly known methods such as a low-speed shearing method, a high-speed shearing method, a friction method, a high-pressure jet method and an ultrasonic method may be applied. Among them, the high speed shearing method is preferable for ensuring a particle diameter of 2 to 20 μm of the dispersion body. When the dispersion device of a high-speed shearing method is used, the revolution number is not particularly limited, but is normally 1,000 to 30,000 revolutions per minute (rpm), and preferably 5,000 to 20,000 rpm. The dispersion time is not particularly limited, but is normally 0.1 to 5 minutes when a batch method is used. The dispersion temperature is normally 0 to 150° C. (under pressure), and preferably 40 to 98° C.

3) Along with preparation of an emulsified liquid, amines (B) are simultaneously added and the emulsified liquid is allowed to react with a polyester prepolymer (A) that has an isocyanate group.

During this reaction, the molecular chain is subjected to the crosslinking reaction and/or the elongation reaction. The reaction time is selected based on a reactivity of an isocyanate group structure contained in the polyester prepolymer (A) with the amines (B), but is normally 10 minutes to 40 hours, and preferably 2 to 24 hours. The reaction temperature is normally 0 to 150° C. and preferably 40 to 98° C. A commonly known catalyst may be used as necessary. To be specific, a catalyst such as dibutyltin laurate or dioctyltin laurate may be used.

4) After completion of the reaction, the organic solvent is removed from the emulsification-dispersion body (reaction product) and the reaction product is cleaned and dried to obtain the parent toner particles.

For removing the organic solvent, the temperature is gradually increased while stirring a laminar flow of the entire reaction product. After strongly stirring the reaction product at a fixed temperature range, the organic solvent is removed to prepare spindle-shaped parent toner particles. Further, if a chemical such as a calcium phosphate, which is soluble in acid and alkali, is used as a dispersion stabilizer, the calcium phosphate is dissolved using an acid such as hydrochloric acid and the resulting solution is washed with water to remove the calcium phosphate from the toner particles. Further, the calcium phosphate may also be removed using a procedure such as enzymatic breakdown.

(5) A charge control agent is added to the parent toner particles obtained with the method described above, and then inorganic fine particles such as silica fine particles or titanium oxide fine particles are externally added to obtain a toner.

The addition of the charge control agent and the external addition of the inorganic fine particles are performed by any known method using, for example, a mixer. A toner including small diameter particles with a sharp particle size distribution can thereby be easily obtained. The strong stirring used in the process of removing the organic solvent can control the particles to have a shape between a sphere and an ellipsoid and to have a surface morphology between being smooth and being wrinkled.

If an image including the transparent toner described above can be formed on a recording medium using dry two-component toner including the transparent toner and the image forming apparatus schematically illustrated in FIG. 1 or 2, high-value added printing including the transparent toner can be performed using an existing image forming apparatus, and this is very preferable.

Therefore, a description will be given of a method of adding an image forming unit for the transparent toner to a very common image forming apparatus illustrated in FIG. 2. As illustrated in FIG. 2, with the image forming apparatus provided with four image forming stations 51 (Y, M, C, and K) for basic four colors of toner, the number of colors of toner used for image formation is, of course, four. The number of image forming stations in the basic platform to which this image forming engine is installed is not enough to add one or more colors of toner to this image forming engine, and therefore an image containing a toner image formed using the transparent toner cannot be formed.

Accordingly, in one embodiment of the present invention, the formation of an image using five or more colors of toner is allowed by replacing some of the image forming stations in the image forming engine having four image forming stations for four colors and performing a plurality of times (twice, for example) of image forming operations. More specifically, the image forming engine is configured such that a plurality of (more than four for basic colors) image forming stations (corresponding to, for example, five colors (the four basic colors+one color (transparent toner)) or more) can be used by, for example, replacing some of the image forming stations, and high-value added printing using the transparent toner can be achieved. For this purpose, the plurality of image forming stations used has the same structure, so that the transparent toner can be used for any one of these image forming stations. In this configuration, suppose that, for example, one color (a transparent toner) is additionally used in the formation of toner images using the basic four colors of toner. In a first image forming operation, images are formed using the basic four colors of toner (yellow, magenta, cyan, and black (Y, M, C, and K)). Then one of the image forming stations used for the formation of a toner image with the basic four colors of toner is replaced with an image forming station for the transparent toner, and a second image forming operation is performed. Alternatively, one of the four image forming stations is replaced, in advance, with the image forming station for the transparent toner. In a first image forming operation, an image is formed using only the transparent toner. Then the image forming station for the transparent toner is replaced with the replaced one of the image forming stations for the basic four colors of toner so that the image forming engine is composed of the image forming stations for the basic four colors of toner, and a second image forming operation is performed. As described above, various image forming sequences can be achieved by replacing one of the image forming stations with the image forming station for the transparent toner or changing the order of the arrangement of the four image forming stations that are arranged in parallel.

In the present invention, the image forming station is a generic term for, for example, a process cartridge including at least a photosensitive element and a developing unit and may include a charging unit and a transfer unit for the photosensitive element in some cases. When an image forming station is replaced, the image forming station itself may be replaced, or only the developing unit of the image forming station may be replaced. When the toner in an image forming station is changed by replacing its developing unit, it is preferable to replace simultaneously a toner replenishment unit for replenishing the developing unit with the toner. However, if the simultaneous replacement of the developing unit and the toner replenishment unit is difficult because of the structure of the image forming apparatus, it is desirable to cover a toner replenishment opening that communicates the toner replenishment unit with the developing unit so that different colors of toner are not mixed. With the operation for closing the opening being performed, an operation for replenishing the developing unit with the toner from the toner replenishment unit may be stopped, so that only the toner present in the developing unit is used to form an image. Alternatively, toner replenishing means other than the normal toner replenishing operation may be used.

The order in which image formation using the transparent toner is performed is determined, for example, by allowing a user to freely select the position of the image forming station to be replaced. Because the image forming stations are configured such that the image forming station for the transparent toner can be used instead of any of the image forming stations, the replacement position or the arrangement position of the image forming station for the transparent toner can, of course, be set freely and unrestrictedly. However, in the general order in which image formation using the transparent toner is performed, the image formed using the transparent toner is placed in the uppermost layer on the surface of a recording medium, i.e., on top of the images formed using other colors of toner on the surface of the recording medium.

A brief description will be given of the general applications of a transparent toner. A first application of the transparent toner is protection of the surface of an image. The protection of the image surface is achieved by covering the surface of an image formed using color toner such as yellow, magenta, cyan, and black (Y, M, C, and K) toner with the transparent toner or by forming an image with the transparent toner around the color toner forming the image surface. In the former case, the transparent toner serves as an overcoat for the image surface, and the overcoat layer formed of the transparent toner protects the surface of the image formed using the color toner. In the latter case, a reduction in the function of protecting an image portion is caused by projection of the color toner on the recording medium, i.e., steps due to the pile height of the toner. This problem, which is specific to electrophotographic image forming apparatus, is solved by making an image with the transparent toner around the projecting portions of the color toner substantially flush with the surface of the color toner.

A second application of the transparent toner is to form a watermark or a pattern with the transparent toner. In this case, when color toner is superimposed on the transparent toner, the watermark or pattern image formed using the transparent toner is no longer visible because of the opacity of the color toner. Therefore, the image with the transparent toner will be formed on the outermost layer of a recording medium. A third application different from the above applications is to modify the surface morphology of a recording medium using the transparent toner. For example, when a recording medium having a smooth surface is used, a fancy paper-like texture can be given to the recording medium by forming a specific pattern image with the transparent toner. Such a texture can be changed by increasing or decreasing the amount of the transparent toner adhering to the recording medium. Particularly, to obtain a high texturizing effect, the adhesion amount is increased, and the image using the transparent toner is formed on the outermost layer of the recording medium. As described above, the transparent toner has various applications. At present, the image using the transparent toner is generally formed on the outermost layer of the image formed on a recording medium. However, in the future, the transparent toner and, for example, basic four colors of toner (yellow, magenta, cyan, and black (Y, M, C, and K)) may be used in any order to form an image.

Figure 5:
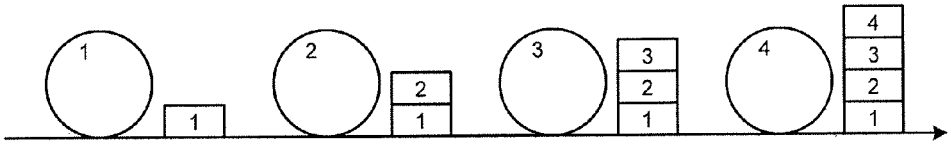
FIG. 5 is a schematic diagram illustrating an example of a prior art, in which four image forming stations are used to form a toner image on an intermediate transfer belt used as a medium to which an image is transferred.
Figure 6A:
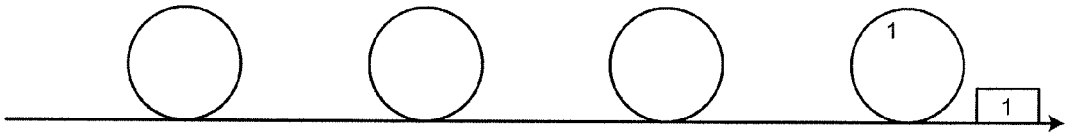
FIGS. 6A and 6B are schematic diagrams illustrating an example in which one of the image forming stations illustrated in FIG. 5 is replaced to form five-color toner images including a transparent-toner image on the intermediate transfer belt, FIG. 6A showing an example in which the image forming station for the transparent toner is disposed on the most downstream side in the moving direction of the intermediate transfer belt, and FIG. 6B showing an example in which the five color-toner images including the transparent-toner image are transferred to the intermediate transfer belt.
Figure 6B:
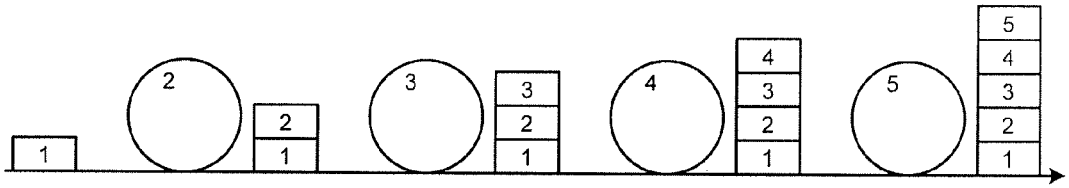

The operation for replacing an image forming station will be further described with reference to FIGS. 5, 6A and 6B. FIG. 5 is a schematic diagram illustrating a conventional example in which toner images are formed on an intermediate transfer belt serving as a medium to which an image is transferred using four colors of toner, i.e., using four image forming stations. FIGS. 6A and 6B are schematic diagrams illustrating an example in which images with five colors of toner including a transparent toner are formed on the intermediate transfer belt by replacing one of the image forming stations illustrated in FIG. 5 with the image forming station of the transparent toner, as in the present invention. Because FIGS. 5, 6A, and 6B are schematic diagrams, only the four photosensitive elements in the image forming stations and the intermediate transfer belt are extracted and drawn. In FIGS. 5, 6A, and 6B, the numbers given to the photosensitive elements and the numbers given to the toner schematically drawn on the intermediate transfer belt 20 represent the order in which the toner images are formed.

As shown in FIG. 5, the intermediate transfer belt 20 moves from the left to the right in the figure, and four colors of toner are transferred to the intermediate transfer belt 20 in the sequence from the photosensitive element of the image forming station on the upstream side in the moving direction of the intermediate transfer belt 20. However, in FIG. 6A, a toner (for example, the transparent toner) is transferred to the intermediate transfer belt only from one image forming station disposed on the rightmost side in the figure. In this embodiment of the present invention, the image forming station on the most downstream side in the state illustrated in FIG. 6A is replaced with an image forming station for a desired color toner. Then the intermediate transfer belt 20 is further driven to rotate, and the toner image transferred to the intermediate transfer belt 20 passes through the secondary transfer unit 60 (see FIG. 2). However, because a toner transfer mechanism described later is temporarily disabled, the transferred toner image returns to the transfer positions for the image forming stations without any influence on the toner image. Then, in FIG. 6B, toner images are further transferred from the respective image forming stations onto the toner on the returned intermediate transfer belt 20, and the toner images using five colors of toner including basic four colors of toner and one additional toner such as the transparent toner can thereby be formed.

The present invention is configured such that, in the series of the above operations, the transparent toner can be used for any one of the plurality of image forming stations used. In FIGS. 6A and 6B, the image forming station on the most downstream side in the moving direction of the intermediate transfer belt 20 is replaced, and five toner images can therefore be formed without greatly modifying the basic configuration of the platform. In the present invention, the image forming order can be freely changed. To deepen the understanding of the present invention, a description will be given of an example in which black toner and transparent toner are used to form a simplest black and white image with the transparent toner combined. For example, in FIG. 6A, the image forming unit in the image forming station on the most downstream side is first used for the transparent toner. Then in a second image forming operation, this image forming station is replaced with the image forming unit for the black toner. In this manner, the image formation using the transparent toner can be performed first. Alternatively, the image forming unit in the image forming station on the most downstream side may be first used for the black toner and then used for the transparent toner in the second operation. In this manner, the image formation using the transparent toner can be performed last. Although not illustrated, if the transparent toner is used for the image forming station on the most downstream side and one of the other three image forming stations is the image forming station for the black toner, the transparent toner may be transferred to the intermediate transfer belt 20 in the first operation. Then in the second operation performed after the intermediate transfer belt 20 is returned to the image forming engine, the black toner may be transferred to the intermediate transfer belt 20 from the image forming station for the black toner that is included in the other three image forming stations. Conversely, the black toner may be transferred in the first operation, and the transparent toner may be transferred in the second operation.

Figure 7A:
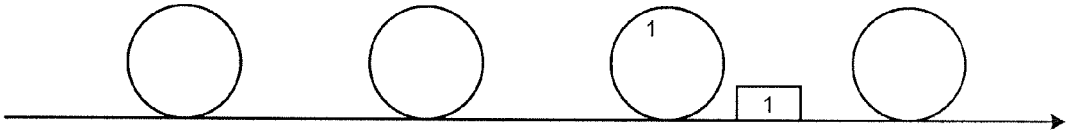
FIGS. 7A and 7B are schematic diagrams illustrating an example in which the image forming station for the transparent toner can be disposed at any position in an image forming engine, FIG. 7A showing an example in which, in contrast to FIGS. 6A and 6B, the image forming station for the transparent toner is disposed at the position of the third image forming station from the upstream side in the moving direction of the intermediate transfer belt, and FIG. 7B showing an example in which five color-toner images including a transparent-toner image are transferred to the intermediate transfer belt.
Figure 7B:
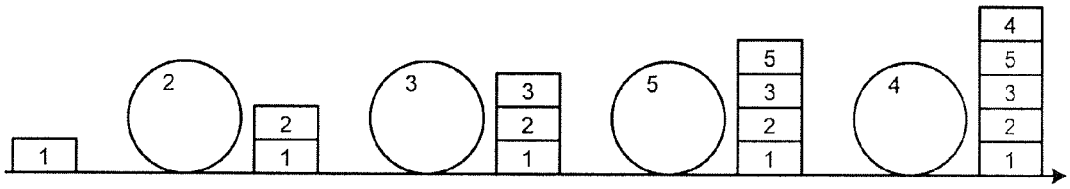

Because the present invention is configured such that the transparent toner can be used by any of the plurality of image forming stations used, the image forming station for the transparent toner can be disposed at any position in the image forming engine. An example thereof is illustrated in FIGS. 7A and 7B. For example, as shown in FIG. 7A, a first image forming operation is performed using color toner (numeral 1) in the third image forming station disposed at the third most upstream position in the moving direction of the intermediate transfer belt 20. Then the third image forming station is replaced with the image forming station for the transparent toner, and images are formed. In this manner, the transparent toner (numeral 5) can be arranged in place of one of the four basic colors of toner, i.e., yellow, magenta, cyan, and black (Y, M, C, and K), as shown in FIG. 7B.

When the image forming station for the transparent toner can be freely placed at any one of the positions of the image forming stations arranged for a plurality of colors of toner in the image forming engine as described above, in the electrophotographic image forming apparatus, the image formed using the transparent toner can be placed, relative to other toner images, at any position that is considered to be the best position by a user. This is preferred because the conditions such as the order in the image formation can be optimized. This also means that the order of the image formation by transferring a toner image using the transparent toner to the medium can be freely set relative to the image formations with the toner other than the transparent toner. This can be achieved by the following example. After a first image is formed using any one of the basic four colors of toner, the toner first used is replaced with the transparent toner. Then the positions of four image forming units including the image forming units for the remaining three of the basic four colors of toner and the image forming unit for the transparent toner can be rearranged. In this manner, the image formed using the transparent toner can be placed, relative to the other toner images, at any position that is considered to be the best position by a user, thereby the image formation condition can be optimized preferably.

The present invention is characterized by the capability of performing a plurality of transfer processes using a preexisting image forming apparatus in achieving high-value added printing including the transparent toner. However, during the plurality of transfer processes, for example, a previously transferred image passes through the secondary transfer unit 60 illustrated in FIG. 2 or reaches again the image forming engine in which the image forming stations are disposed and then passes through the primary transfer nip formed by the photosensitive elements 11 and the primary transfer rollers 38. In such a case, it is preferable to perform a temporarily disabling operation of a transfer for disabling the toner transfer mechanism temporarily so that the toner image previously formed on the transfer destination medium is not disturbed. The temporarily disabling operation of the transfer can be achieved by the operation for stopping or reducing the supply of the transfer electric field at the transfer nip or the operation, using, for example, solenoids (not shown), to reduce the pressures from the transfer members forming the transfer nip, for example, including the counter roller 36 in the secondary transfer unit and the primary transfer rollers 38 (Y, M, C, and K) in the primary transfer unit illustrated in FIG. 2, or to separate the transfer members from each other. Such a temporarily disabling operation of a transfer is a function generally provided in a current image forming apparatus and is activated when, for example, a toner patch on a test object is not disturbed in a process control. The transfer temporarily disabling operation in the present invention is not strictly defined and is viable so long as a toner image on a transfer destination medium is not disturbed.

Figure 8A:
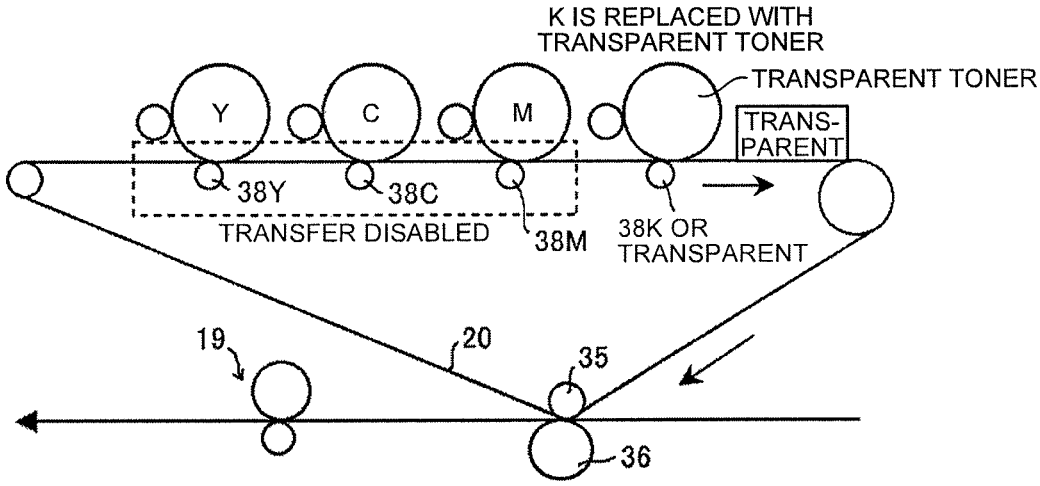
FIG. 8A is one of process diagrams illustrating temporary disabling of transfer, the diagram showing a state in which a toner image formed using the transparent toner is transferred to the intermediate transfer belt.
Figure 8B:
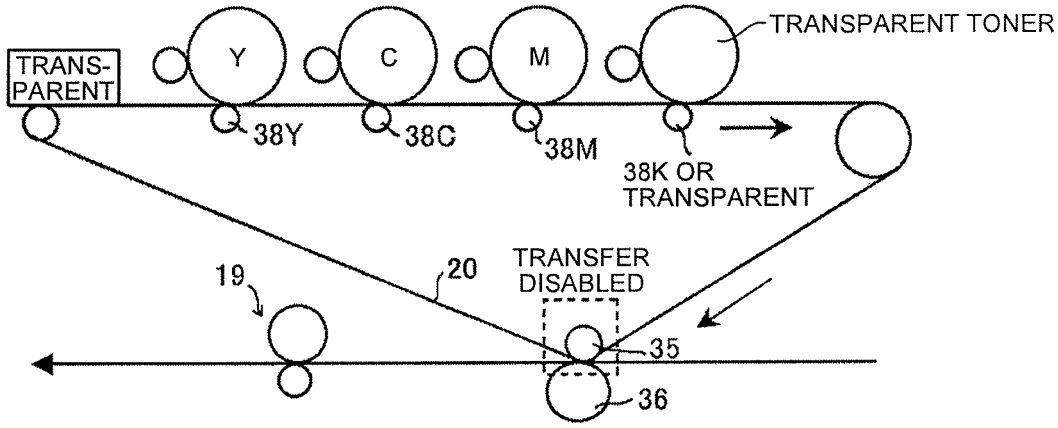
FIG. 8B is one of the process diagrams illustrating the temporary disabling of the transfer, the diagram showing a state in which the toner image formed using the transparent toner is re-conveyed to the image forming engine without a disturbance of the toner image because transfer is temporarily disabled.
Figure 8C:
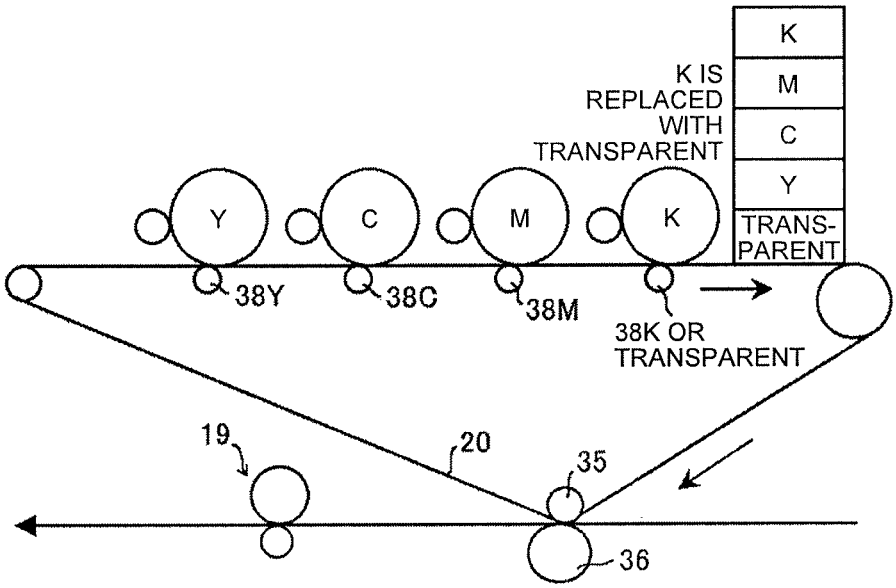
FIG. 8C is one of the process diagrams illustrating the temporary disabling of the transfer, the diagram showing a state in which the image forming station for the transparent toner is replaced with the image forming station for a black toner and toner images are formed using four basic colors on the transparent toner image re-conveyed to the image forming engine without a disturbance.
Figure 8D:
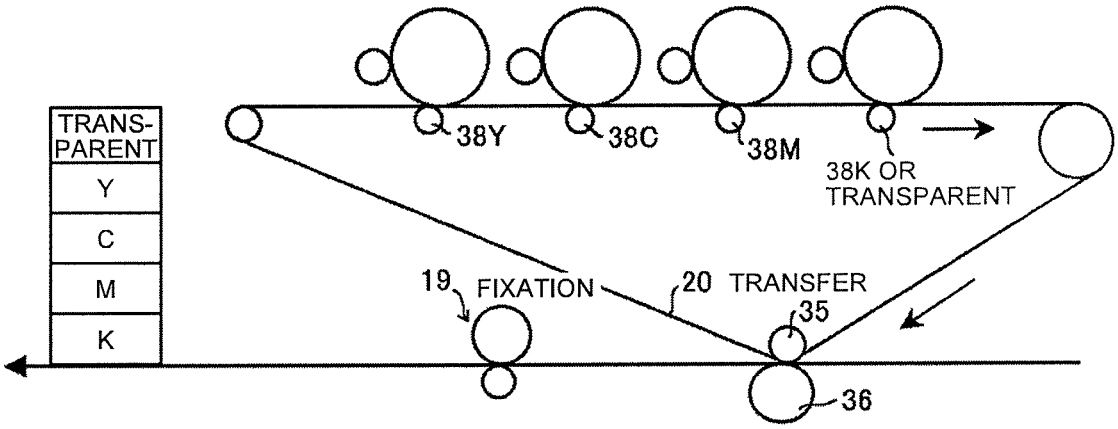
FIG. 8D is one of the process diagrams illustrating the temporary disabling of the transfer, the diagram showing a state in which the toner images formed using the five colors of toner including the transparent toner are transferred to the recording medium to be fixed.

The temporarily disabling operation of the transfer will be described with reference to FIGS. 8A to 8D. FIGS. 8A to 8D are process diagrams for illustrating the temporarily disabling operation of the transfer and the means therefor. FIG. 8A shows a state in which a toner image formed using a transparent toner is transferred to the intermediate transfer belt 20 serving as a transfer destination medium. FIG. 8B shows a state in which the toner image formed using the transparent toner is re-conveyed to the image forming engine without a disturbance of the toner image due to the activation of the temporarily disabling operation of the transfer. FIG. 8C shows a state in which the image forming station for the transparent toner is replaced with the image forming station for a black toner and toner images are formed using the four basic colors of toner on the transparent toner image having been re-conveyed to the image forming engine without a disturbance. FIG. 8D shows a state in which the toner images formed using the five colors of toner including the transparent toner are transferred to the recording medium and fixed.

First, in FIG. 8A, a transparent toner image is transferred to the intermediate transfer belt 20. During the transfer, for example, in the image forming stations for color toner (yellow, cyan, and magenta (Y, C, and M)) other than the image forming station for the transparent toner, the transfer electric field is not supplied to the primary transfer rollers 38 (Y, C, and M), so that a toner image is not transferred to the intermediate transfer belt 20. Next, to obtain the state illustrated in FIG. 8B, when the intermediate transfer belt 20 having the transparent toner image transferred thereon passes through the secondary transfer unit 60, a secondary transfer bias is not supplied to the counter roller 36, and/or the counter roller 36 is separated from the intermediate transfer belt 20. Hence, the transparent toner image transferred to and carried on the intermediate transfer belt 20 is re-conveyed to the image forming engine without any influence on the transparent toner image. Then, as illustrated in FIG. 8C, the image forming station for the transparent toner is replaced with the image forming station for the black toner, and each of toner images formed using color toner of yellow, cyan, magenta, and black (Y, C, M, and K) is transferred to the intermediate transfer belt 20. Finally, as illustrated in FIG. 8D, all the five color toner images including the transparent toner image on the intermediate transfer belt 20 are transferred to a recording medium altogether by applying a secondary transfer voltage to the counter roller 36 in the secondary transfer unit 60, and the recording medium having the five color toner images transferred thereon is fixed in the fixing unit 19. As described above, in the present invention, because all the five color toner images can be fixed by a single fixing operation, a plurality of fixing operations are not needed. Therefore, an excessive amount of heat is not applied to the toner images on the recording medium, allowing energy saving and further leading to prevention of excessive warpage in the recording medium after image formation and reduction in gloss abnormality. Accordingly, the quality of the recording medium can be improved.

In the example illustrated above, description is given of the method to perform high-value added printing using a plurality of image forming stations including the image forming station for the transparent toner by replacing one of the four image forming stations provided in the image forming engine with the image forming station for the transparent toner. However, the present invention is not limited thereto. The present invention is also applicable to, for example, an image forming apparatus including an image forming engine provided with five or more image forming stations. In such an image forming apparatus, because more than four, such as five, for example, image forming stations are provided, one of the image forming stations is used as the image forming station for a transparent toner, and a plurality of transfer operations are performed so that the desired number of toner images including a transparent toner image are formed on a transfer destination medium. In this case, the object of the present invention can be achieved if a user can freely determine, or a control means automatically determines, the order in which the transparent toner is transferred to the transfer destination medium from the image forming station for the transparent toner and other colors of toner than the transparent toner are transferred to the transfer destination medium from image forming stations in which the transparent toner is not used. More specifically, irrespective of whether or not any of the image forming stations is replaced, the present invention can be achieved by performing a plurality of times of image forming operations using a plurality of image forming stations including an image forming station that can use the transparent toner. Also in this case, it is preferable to activate the temporarily disabling operation of the transfer described above.

In the above example used to deepen the comprehension of the present invention, although twice of image forming processes are performed on the intermediate transfer belt 20 serving as a transfer destination medium, the present invention is not limited thereto. For example, the image forming process may be further repeated, i.e., the image forming process may be repeated three times or more to form images. This will be described in that, for example, a yellow toner mage can be formed on the transfer destination medium in the first transfer process, then a transparent toner image can be formed on the transfer destination medium in the second transfer process, and the rest of the toner images (cyan, magenta, and black toner images) can be transferred to the transfer destination medium in the third transfer process. Because a plurality of transfer processes can be performed as described above, the order of image formation can be simply and easily changed to the optimal order according to a user's intention to apply the transparent toner without significantly changing the configuration of a pre-existing image forming apparatus. The image forming apparatus may be configured such that, when a plurality of image forming processes are performed as described above, the transfer destination medium passes through the transfer nip a plurality of times, i.e., any number of times, until a final toner image in which the transparent toner image is disposed or placed on the outermost layer of the recording medium. In this configuration, although the productivity in the image forming operations is reduced, an order of image formation processes in which the transparent toner image is formed on the outermost layer of the recording medium (this is the most common application of the transparent toner) can be always performed.

The present invention is also characterized in that a user can freely, or a control means will automatically, select or change the order in which the transparent toner is transferred to the transfer destination medium from the image forming station for the transparent toner and other colors of toner than the transparent toner are transferred to the transfer destination medium from image forming stations in which the transparent toner is not used, as described below.

Figures 9, 10:
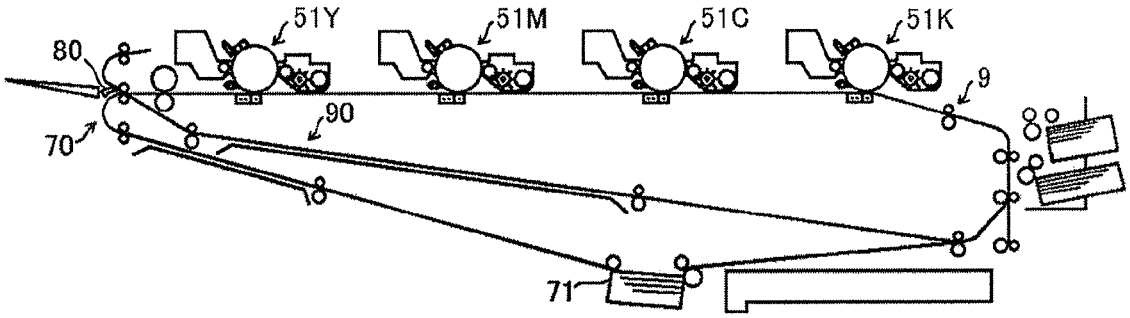
FIG. 9 is a diagram showing an example of a display on the image forming apparatus that is used to allow a user to select whether the transparent toner is to be used at the default-set position of an image forming station or at the position of a different image forming station.
FIG. 10 is a schematic cross sectional view illustrating an example of a modification of the present invention.

First, a description will be given of an image forming apparatus that can perform high-value added printing including the transparent toner by replacing any of the image forming stations in the image forming engine. In the present invention, for example, the position of the image forming station for the transparent toner that is to be placed in the image forming engine can be set or registered as a default setting in a control unit used as the control means provided in the image forming apparatus. In this case, in the image forming apparatus, the user is allowed to select whether or not the default is used when an image forming station is replaced. The user is also allowed to select whether or not the image forming station for the transparent toner is used at the position of an image forming station different from the default setting. In this case, when an instruction to perform high-value added printing using the transparent toner is input to the image forming apparatus, for example, the display illustrated in FIG. 9 is displayed on the image forming apparatus to allow the user to select whether the transparent toner is used at the position of an image forming station set as the default setting or at the position of a different image forming station. The image forming apparatus may be configured such that, if no input is given by the user even after a predetermined time elapses since when the display has appeared, the default setting is automatically selected. With this configuration, a user can freely, or a control means will automatically, select or change the order in which the transparent toner is transferred to the transfer destination medium from the image forming station for the transparent toner and other colors of toner than the transparent toner are transferred to the transfer destination medium from image forming stations in which the transparent toner is not used. Therefore, an order of the image formation can be simply and easily changed to the optimal order according to the application of the transparent toner.

In an image forming apparatus in which, for example, five or more image forming stations are provided and therefore the image forming station for a transparent toner can be preinstalled, the order in which image formation using the transparent toner is performed can be preset as a default setting. In addition, a display (not shown) for selecting the order of the toner image formation (for example, 1: transparent, Y, M, C, and K, 2: transparent, Y, M, C, and K, . . . ) is displayed on the image forming apparatus to allow the user to make a selection. Also in this case, if no input is given by the user after a predetermined time elapses since when the display has appeared, it is possible to let the control unit determine that the default setting has been automatically selected.

A modification of the present invention will be described next with reference to FIG. 10. FIG. 10 is a schematic cross sectional view illustrating a modified example of the present invention. Specifically, the conveying path of the recording medium in the image forming apparatus illustrated in FIG. 1, extending from the downstream side of the fixing unit 19 to the image forming engine having the four image forming stations disposed therein, is provided with a formed image re-conveying path 70 for conveying a recording medium subjected to fixation to the image forming engine again. The modified example is also different in that a storage area 71 for temporarily storing a recording medium having been subjected to a fixation operation and to be subjected to the next fixing operation is provided in the formed image re-conveying path 70. Of course, the formed image re-conveying path 70 and a recording medium conveying path 75 described below can be provided in the image forming apparatus illustrated in FIG. 2.

In the example illustrated in FIG. 10, after a transfer process for transferring at least one toner image to a recording medium used as a transfer destination medium from at least one of a plurality of image forming stations used is first performed, the process of fixing the toner image to the recording medium is performed in the fixing unit 19. Then to perform the process of transferring at least one toner image to the transfer destination medium from at least one of the rest of the image forming stations and the process of fixing the at least one toner image to the recording medium by the fixing unit 19, the recording medium is conveyed to the formed image re-conveying path 70. In order to accomplish this, a switching flap 80 for switching between the conveying path in the normal sheet discharge direction and the formed image re-conveying path 70 is provided on the downstream side of the recording medium conveying path 75 in the fixing unit 19. The switching flap 80 is configured such that the conveying direction of the recording medium can be changed to the direction toward the formed image re-conveying path 70 by performing the switching operation of the switching flap 80 using, for example, a solenoid (not shown). The recording medium to be conveyed again to the image forming engine through the formed image re-conveying path 70 is temporarily stored in the storage area 71 disposed in the formed image re-conveying path 70. While the recording medium is stored in the storage area 71, for example, the image forming station for the transparent toner can be replaced with any of the image forming stations for the basic four colors of toner, or, conversely, one of the image forming stations for the basic four colors of toner can be replaced with the image forming station for the transparent toner. While the recording medium is stored in the storage area 71, for example, a message for prompting the user to replace an image forming station can be displayed on the image forming apparatus. Then the process of transferring at least one toner image to the medium to which an image is transferred from at least one of the rest of the image forming stations and the process of fixing the image to the recording medium by the fixing unit are performed at least once. Moreover, a plurality of fixing operations are performed on the recording medium by repeating the conveyance of the recording medium to the image forming engine through the formed image re-conveying path 70 and also forming images using different colors of toner. In this manner, plural times of fixing operations are performed on the recording medium, and toner images formed using the desired number of colors of toner, including the transparent toner, are fixed to the same single surface of the recording medium. Finally, the conveying direction of the switching flap 80 is changed to a sheet discharge direction leading to the outside of the image forming apparatus to eject the recording medium to, for example, a discharge tray. As described above, the provision of the storage area 71 is convenient for a user because the user is not bothered with the handling of the recording medium during the image formation.

In the example illustrated in the figure, a reversed recording medium conveying path 90 used to form an image on the reverse side, i.e., to allow the so-called duplex printing is also provided. More specifically, the duplex printing is achieved as follows. The switching flap 80 is switched to the side opposite to the side leading a medium to the formed image re-conveying path 70 so as to convey the recording medium upward in the figure to switch back the recording medium, thereby the recording medium is reversed, and the reversed recording medium is re-conveyed to the image forming engine. Such a reversed recording medium conveying path 90 used to form images on both sides of a recording medium is well known to a person skilled in the art, and image forming apparatus provided with such a reversed recording medium conveying path 90 are widely available on the market. In the example shown, to deepen the understanding of the present invention, the reversed recording medium conveying path 90 and the formed image re-conveying path 70 are configured as separate conveying paths, but the present invention is not limited thereto. For example, although different from the configuration in the example described above, a portion of the reversed recording medium conveying path 90, i.e., a conveying path in the downstream of the switching flap 80 through which the switched-back recording medium is conveyed to the image forming engine may also serve as the formed image re-conveying path 70. When a portion of the reversed recording medium conveying path 90 also serves as the formed image re-conveying path 70, the object of the invention can be achieved only by disposing a storage area 71 in the pre-existing reversed recording medium conveying path 90 and by modifying the control system. This is preferred because the original configuration of the image forming apparatus is not required to change largely from a pre-existing configuration.

The example to provide the formed image re-conveying path 70, as illustrated in FIG. 10, is applicable not only to the image forming apparatus illustrated in FIG. 1 in which toner images are directly transferred to a recording medium, i.e., an image forming apparatus in which a recording medium is used as a transfer destination medium, but also to the image forming apparatus of the four-drum tandem type illustrated in FIG. 2 by providing a switching flap 80 and a formed image re-conveying path 70 similar to those, as described above. In this case, the reversed recording medium conveying path 90 may also serve as the formed image re-conveying path 70. In the example illustrated in FIG. 10, the storage area 71 is disposed inside the image forming apparatus body. However, in the configurations of some image forming apparatus, for example, an external device inline-connected with the image forming apparatus is provided so that a recording medium is conveyed between the image forming apparatus and the external device. In such a case, a storage area for temporarily storing a recording medium may be disposed in the external device inline-connected with the image forming apparatus.

In the above image forming apparatus, the operation for transferring a toner image to a recording medium and then fixing the toner image is performed for the number of times corresponding to the number of the plurality of toner image forming operations performed. In this case, if the plurality of fixing operations are performed under the same conditions as those used for a normal fixing operation i.e., under the conditions used when fixing operation is performed only once, an excessively large amount of heat is applied to the recording medium and the toner images carried on the recording medium. Therefore, in the present invention, the conditions for the last one of the plurality of fixing operations performed are made different from those for the other fixing operations (the fixing operations other than the last fixing operation) so that, during the whole of a plurality of fixing operations, an excessively large amount of fixing heat is not applied to the toner images on a recording medium on which a final image is to be formed. This configuration allows energy-saving in the image forming apparatus and can reduce the warpage of the recording medium and gloss abnormality in an image formed on a recording medium that are caused by an excessively large amount of heat applied to the recording medium. This can contribute to improvement in the quality of the recording medium output from the image forming apparatus. By configuring the image forming apparatus such that the amount of heat applied to a recording medium under the conditions for the last one of the fixing operations is lower than that under the conditions for the other fixing operations, the amount of heat applied to the recording medium and the toner images on the recording medium can be most easily adjusted and reduced, and an excessive amount of heat is thereby not applied, which is preferable.

A description will be given of the amount of heat applied to a recording medium and a toner image on the recording medium under the conditions for such a fixing operation. It is generally known that the amount of heat supplied to the recording medium and the toner image during a fixing operation is represented as a function of the interface temperature, thermal conductivity, specific heat, and the like of a fixing member. However, it is also known that various types of interactions based on various factors are present in an actual fixing behavior, and therefore the behavior is very complicated. Accordingly, in controlling the amount of heat supplied during a fixing operation, the amount of heat applied to a recording medium and a toner image is not directly controlled; instead, the fixing temperature, the fixing linear velocity, and the like are generally controlled.

In the configuration for changing the amount of fixing heat in the present invention, one of or a combination of at least two of the fixing temperature, fixing linear velocity, fixing pressure, and the width of the fixing nip is changed such that the conditions for the last fixing operation becomes different from the conditions for the other fixing operations (the conditions for the fixing operations other than the last fixing operation). More specifically, when the conditions for the last fixing operation are made different from the conditions for the other fixing operations, i.e., the amount of heat applied to a recording medium under the conditions for the last fixing operation is made lower than that under the conditions for the other fixing operations performed previously, one of or a combination of at least two of the fixing temperature and fixing pressure of the fixing unit 19, the width of the fixing nip, and the fixing linear velocity may be reduced during the last fixing operation.

The control of the fixing temperature can be achieved by using commonly used means such as the control of the temperature of a heater inside the heating roller using a thermostat. The control of the fixing linear velocity can be achieved by using a function provided in a commonly used image forming apparatus, for example, the function of reducing the fixing linear velocity to apply a sufficient amount of fixing heat to a thick recording medium. To reduce the fixing linear velocity, the conveying linear velocity of a recording medium may be reduced in the entire image forming apparatus. The control of the fixing pressure can be achieved by using commonly used means. For example, a solenoid or a cam having a separating function is provided in the pressure roller so that the pressure between the heating roller and the pressure roller is reduced by the action of the separating function. The control of the width of the fixing nip can be achieved by using commonly used means. For example, the position of the center axis of the pressure roller in the fixing unit 19 is moved relative to the position of the center axis of the heating roller, for example, by a position changing operation using a solenoid, a cam, and the like To determine the conditions for a fixing operation as described above, experiments in a real apparatus are repeated to determine the optimal conditions for a fixing operation, and the optimal conditions can also be obtained at the design stage. These conditions must be determined such that at least toner images are not disturbed during a plurality of fixing operations performed. An example of the experiment for the determination will be described below with reference to FIG. 11.

Figure 11:
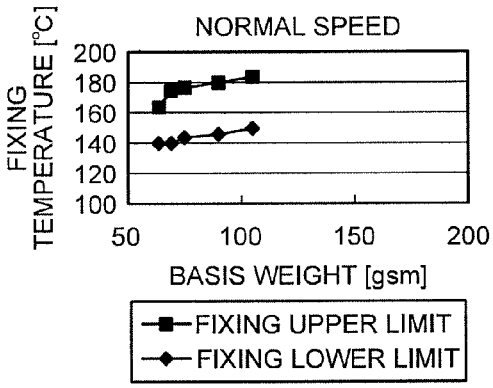
FIG. 11 is a set of diagrams showing an example of an experiment for determining the conditions for a fixing operation.
Figure 11:
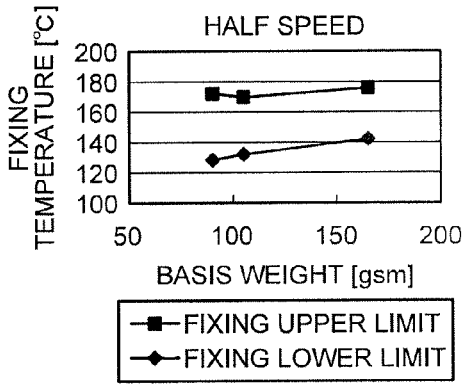

FIG. 11 shows the example of the experiment for determining the conditions for a fixing operation. Referring to FIG. 11, a description will be given of the upper and lower limits of the amount of fixing heat when the fixing temperature and fixing linear velocity are controlled in the fixing unit 19. The experiment was performed using a dry electrophotographic full-color digital copying machine (Imagio Neo C2500, product of Ricoh Company, Ltd.) of the intermediate transfer belt type. The results of the experiment are illustrated in FIG. 11. In each of the graphs in FIG. 11, the horizontal axis denotes the basis weight of a recording medium, and the vertical axis denotes fixing temperature. The fixing lower limit in the graphs corresponds to the value when deterioration of fixability is found in a drawing test method, and the fixing upper limit corresponds to the value when at least one of a reduction in glossiness, winding around a fixing member, and catching on a separation plate is found. As is clear from FIG. 11, it has been found that, when a normal fixing linear velocity is used, the above problems do not arise under the fixing heat application conditions of a fixing temperature of about 140° C. to 180° C. and a basis weight in the range of 65 grams per square meter (gsm) to 105 gsm. The results when the fixing linear velocity is one half of the above value have been found to be similar to the above results. These results indicate that the conditions for the fixing operations performed on a recording medium having a basis weight in the range of 65 gsm to 105 gsm can be chosen such that the fixing temperature is set to 170° C. for the fixing operations other than the last fixing operation and to 140° C. for the last fixing operation. The fixing temperature can be further reduced by half the fixing linear velocity in the conditions for the last fixing operation.

Figure 12:
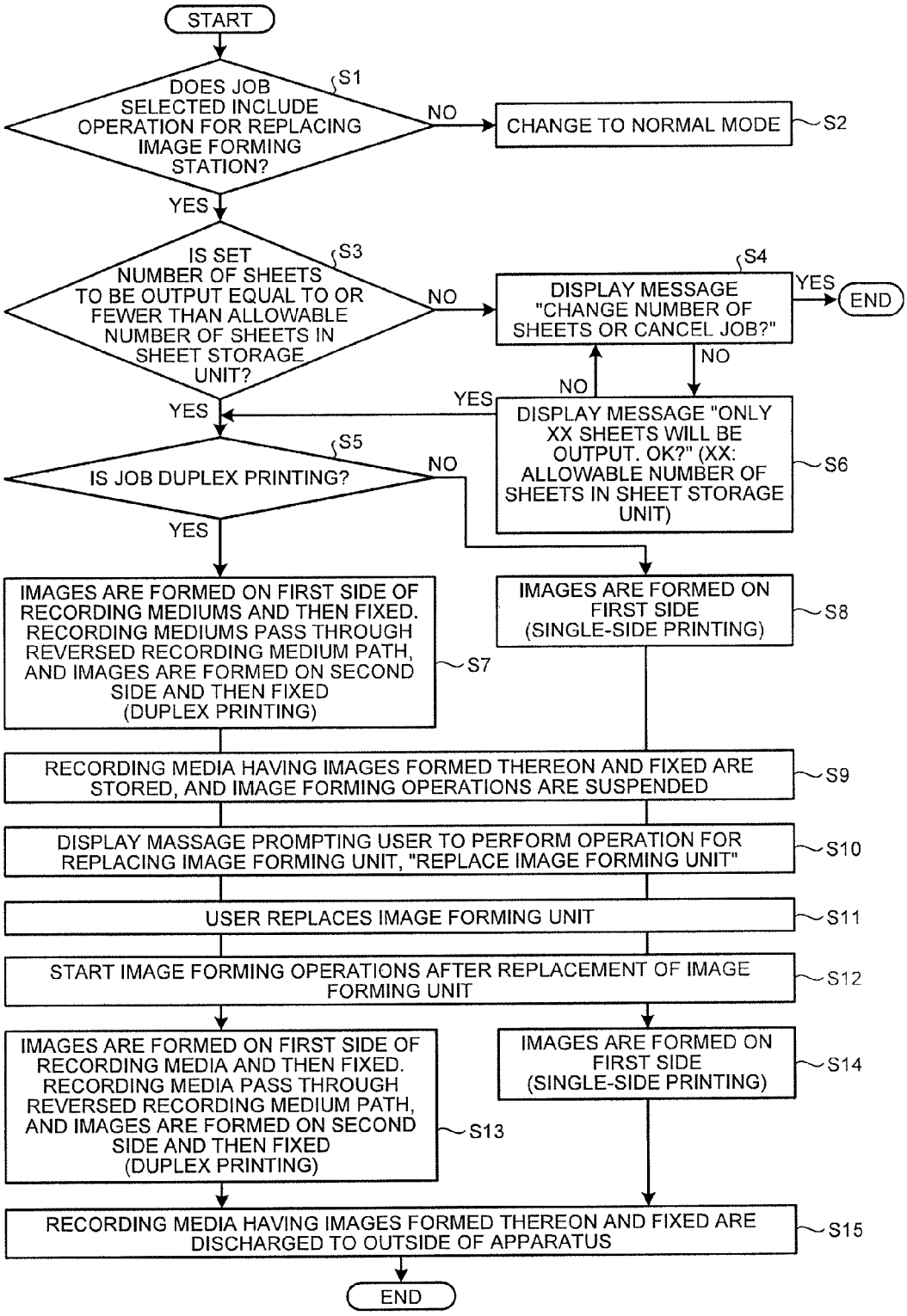
FIG. 12 shows a processing flow in the image forming apparatus in which an image forming station included in the image forming engine of the image forming apparatus as illustrated in FIG. 10 is replaced to form toner images using five or more colors of toner including transparent toner.

Finally, a description will be given of a processing flow in the image forming apparatus illustrated in FIG. 10 with reference to FIG. 12 showing the processing flow. In this processing flow, an image forming station in the image forming engine of the image forming apparatus, as illustrated in FIG. 10, is replaced to form five or more colors of toner images including a transparent toner image. In FIG. 12, first, an image forming job is submitted to the image forming apparatus when a user operates a personal computer disposed at a local position or directly operates the image forming apparatus to input the job. Then the control unit, for example, of the image forming apparatus determines whether or not the job includes replacing an image forming station, for example, to perform high-value added printing using transparent toner (step S1). If the image forming job does not include replacing an image forming station (No in step S1), the process is performed in a so-called normal output mode (step S2).

If the job includes replacing an image forming station (Yes in step S1), a determination is made as to whether the number of recording media to be output in the job is equal to or fewer than the allowable number of media in a recording medium storage unit included in an output unit (step S3). If the number exceeds the allowable number of media (No in step S3), the determination result is displayed on, for example, an operation panel or display device of the output unit or may be displayed on, for example, a personal computer at a local position through a network. The display may be an alert lamp or alert sound so that the user can be notified of the result. Then a prompt for selecting on whether the number of media is changed or the job is cancelled is displayed (step S4), and the selection by the user is accepted (step S6).

Then a determination is made as to whether or not the accepted image forming job is a duplex print job (step S5). When duplex printing is performed (Yes in step S5), first, toner images are transferred to one side and then fixed. The recording medium having the toner images fixed thereon is re-conveyed to the image forming engine by the action of the switching flap 80 through the reversed recording medium conveying path 90, and toner images are transferred to the back side, which is the side opposite to the side on which the images have been formed, and then fixed in a similar manner to the normal image forming operations for duplex printing (step S7). In the image forming apparatus illustrated in FIG. 10, duplex printing is performed using the reversed recording medium conveying path 90. When single-side printing is performed (No in step S5), the operations to be performed are the same as those for normal single-side output, i.e., images are transferred to one side and then fixed in the fixing unit 19 (step S8). In each of these modes, all the recording media having toner images fixed to their single side or both sides are conveyed to the formed image re-conveying path 70 by the action of the switching flap 80 and are temporarily stored in the storage area 71 disposed in the formed image re-conveying path 70, and then the series of image forming operations is temporarily suspended (step S9).

Then a message prompting replacement of an image forming station is displayed on, for example, the operation panel or display device of the output unit or on the personal computer disposed at a local position through the network (step S10). The display may be an alert lamp or alert sound so that the user can be notified of the result. As described above, the image forming station is replaced at the timing between completion of the image forming operation performed on the specified image forming station and the re-start of the image forming operation for forming a toner image on the photosensitive element of the replaced image forming station. Preferably, the image forming apparatus is controlled so as to temporarily suspend any image forming operation automatically and to prompt the user to replace the specified image forming station. In this case, as described above using FIG. 9, the user may be allowed to select which one of the image forming station to be replaced between the image forming station at the default position and the image forming station at a position optionally selected by the user. The selection of the position of the image forming station to be replaced may be made when the image forming job described above is submitted. As described above, the position of the image forming station to be replaced may be automatically selected to be the placement position of the image forming station specified by the user in advance when the image forming job is submitted or may be selected to be the placement position of any other image forming stations. It is preferable that the user be allowed to freely select the position of the image forming device to be replaced at the timing at which a message prompting replacement of an image forming station is displayed, because this allows the user to hurriedly change the replacement position of the image forming device with transparent toner.

Then, the user replaces the image forming station (step S11). For example, the image forming station at the freely selected position in the image forming engine is replaced with the image forming station for the transparent toner. In this replacement operation, the image forming station itself may be replaced, as described above; alternatively, only the developing unit or the developing unit and toner replenishment unit of the image forming station may be replaced.

After the replacement of the image forming station, the image forming operations are resumed (step S12). During the operations, toner images are formed by the image forming station disposed at the replacement position. When duplex image printing has been selected, the resumed image forming operations are performed on both sides using the reversed recording medium conveying path that may also serve as the formed image re-conveying path (step S13). More specifically, image transfer and fixing are performed on both sides of the recording media. When single-side printing has been selected, image transfer and fixing are performed only on one side (step S14). In these cases, the conditions for the fixing operations in the fixing unit 19 are set such that, for example, the amount of heat applied to the recording media and the toner images is smaller than that in the conditions for pervious image fixing operations. Then the recording media having images formed thereon by the desired high-value added printing are discharged to the outside of the image forming apparatus (step S15), and the series of image forming operations is completed.

In the present invention, after the process of transferring at least one toner image to the transfer destination medium, to which an image is transferred, from at least one of a plurality of image forming stations used is performed, the process of transferring at least one toner image to the transfer destination medium from at least one of the rest of the image forming stations is performed at least once. In this manner, toner image transfer is performed a plurality of times on the transfer destination medium, and the toner images on the transfer destination medium are formed using a desired number of colors of toner including the transparent toner. In this case, a user can freely select or change, including automatic selection or change through a control means, the order in which the transparent toner is transferred from the image forming station that is used for the transparent toner to the transfer destination medium and the order in which a plurality of colors of toner other than the transparent toner are transferred from image forming stations in which the transparent toner is not used to the transfer destination medium. Therefore, when the transparent toner is used, the image formation order can be simply and easily changed to the optimal order according to the application of the transparent toner without significantly changing the configuration of a pre-existing image forming apparatus. In addition, with this configuration, it is sufficient to perform only one fixing operation for fixing the toner images to the recording medium. Therefore, an excessive amount of heat is not applied to the toner images on the recording medium. This achieves energy-saving and a reduction in gloss abnormality and can prevent excessive warpage of the recording medium after image formation, and the quality of the recording medium can therefore be improved.

In addition, after performing the process of transferring at least one toner image to the transfer destination medium from at least one of the plurality of image forming stations used, the process of fixing the toner image on the transfer destination medium to the recording medium by the fixing unit is performed. Then the process of transferring at least one toner image to the transfer destination medium from at least one of the rest of the image forming stations and the process of performing fixation to the recording medium by the fixing unit are performed at least once. A plurality of fixing operations are therefore performed on the recording medium to fix the toner images formed using the desired number of colors of toner including the transparent toner to a single surface of the recording medium. When this configuration is used, a formed image re-conveying path for re-conveying the recording medium from the fixing unit to the image forming engine is provided so that the plurality of fixing operations are performed. The formed image re-conveying path has a storage area that is provided to temporarily store the recording medium subjected to at least one fixing operation and to be subjected to the next fixing operation. Therefore, the user can handle the image forming apparatus simply and easily because the user is not bothered with the handling of the recording medium during the image forming operations. In addition, when a plurality of fixing operations are performed, the conditions for the last fixing operation are made different from the conditions for the other fixing operations, so that an excessive amount of heat is not applied to the toner images on the recording medium. This achieves energy-saving and a reduction in gloss abnormality and can prevent excessive warpage of the recording medium after the image formation; thereby the quality of the recording medium can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a plurality of image forming stations each including at least a developing unit and a photosensitive element, the image forming stations forming an image forming engine;

a transfer medium to which toner images visualized on the respective photosensitive elements by the respective developing units are transferred; and a fixing unit that performs a fixing operation to fix a transferred toner image on the transfer medium to a recording medium, wherein a transparent toner can be used for any of the plurality of image forming stations, wherein the image forming engine performs a plurality of times of toner image transferring on the transfer medium by performing transferring at least one toner image to the transfer medium from at least one of the image forming stations and by performing at least once transferring at least one toner image from at least one of the rest of the image forming stations, whereby the toner images on the transfer medium are formed using a desired number of colors of toner including the transparent toner, and wherein the image forming apparatus further comprises a control unit configured to change automatically or in accordance with a user's selection a transfer order of transferring the transparent toner from the image forming station using the transparent toner and a toner other than the transparent toner from the image forming station not using the transparent toner.

2. The image forming apparatus according to claim 1, wherein after the image forming engine performs transferring the at least one toner image to the transfer medium from the at least one of the image forming stations, the fixing unit performs fixing the toner images on the transfer medium to the recording medium, and then the image forming engine performs transferring the at least one toner image to the transfer medium from the at least one of the rest of the image forming stations and the fixing unit performs fixing the toner images to the recording medium at least once, whereby the fixing unit performs a plurality of fixing operations on the recording medium to fix the toner images formed using the desired number of colors of toner including the transparent toner to a single surface of the recording medium, wherein the image forming apparatus further comprises a formed image re-conveying path for conveying the recording medium from the fixing unit to the image forming engine again so that the plurality of fixing operations are performed, the formed image re-conveying path having a storage area that is provided to temporarily store therein the recording medium having been subjected to the fixing operation and to be subjected to the next fixing operation, and wherein conditions for a last one of the plurality of fixing operations performed are different from conditions for the rest of the fixing operations.

3. The image forming apparatus according to claim 1, wherein the transfer medium is any one of an intermediate transfer medium and the recording medium.

4. The image forming apparatus according to claim 1, wherein the image forming station using the transparent toner can be freely disposed at any position in the image forming engine.

5. The image forming apparatus according to claim 1, wherein the transfer order of the transparent toner can be set at any position with respect to the image forming stations other than the image formation station using the transparent toner.

6. The image forming apparatus according to claim 1, wherein the transfer medium passes through a transfer nip a plurality of times until the image of the transparent toner is obtained as an outermost one of the toner images on the recording medium.

7. The image forming apparatus according to claim 1, further comprising a unit for temporarily disabling a toner transferring mechanism when at least one toner image transferred from at least one of the image forming stations is present on the transfer medium.

8. The image forming apparatus according to claim 7, wherein the unit for temporarily disabling the toner transferring mechanism is any of an operation for stopping or reducing supply of a transfer electric field in a transfer nip and an operation for reducing a pressure applied by transfer members forming the transfer nip or for separating the transfer members from each other.

9. The image forming apparatus according to claim 1, wherein the number of the image forming stations is four or larger.

10. The image forming apparatus according to claim 1, wherein, when at least one of the plurality of image forming stations is replaced, only the developing unit of the image forming station is replaced, or the developing unit and a toner replenishment unit of the image forming station are replaced.

11. The image forming apparatus according to claim 10, wherein timing to replace the image forming station is achieved at a placement position of an image forming station that is pre-specified by a user to be replaced or optionally specified by the user, at timing to replace an image forming operation occurring between completion of an image forming operation performed on the specified image forming station and re-start of the image forming operation for forming a toner image on the photosensitive element of the specified image forming station.

12. The image forming apparatus according to claim 10, wherein, when a toner for image formation is replaced, the image forming apparatus temporarily suspends any image forming operation automatically at timing to replace the specified image forming station that is specified in advance or optionally specified by the user, and the image forming apparatus is controlled to prompt the user to replace the specified image forming station.

13. The image forming apparatus according to claim 2, wherein the storage area is disposed inside the image forming apparatus or in an external device that is inline-connected with the image forming apparatus.

14. The image forming apparatus according to claim 2, wherein an amount of heat applied to the recording medium under the conditions for the last fixing operation is smaller than amounts of heat under the conditions for the other fixing operations.

15. The image forming apparatus according to claim 14, wherein, in order to set the amount of heat applied to the recording medium during the last fixing operation to be smaller than the amounts of heat during the other fixing operations having been performed previously, one of or a combination of at least two of a reduction in fixing temperature, a reduction in fixing pressure, a reduction in a width of a fixing nip, and a reduction in fixing linear velocity is performed in the fixing unit during the last fixing operation.

* * * * *